US008398456B2

(12) United States Patent
Kobayashi et al.

(10) Patent No.: US 8,398,456 B2
(45) Date of Patent: Mar. 19, 2013

(54) POLISHING METHOD, POLISHING APPARATUS AND METHOD OF MONITORING A SUBSTRATE

(75) Inventors: Yoichi Kobayashi, Tokyo (JP); Yasumasa Hiroo, Tokyo (JP)

(73) Assignee: Ebara Corporation, Tokyo (JP)

( * ) Notice: Subject to any disclaimer, the term of this patent is extended or adjusted under 35 U.S.C. 154(b) by 395 days.

(21) Appl. No.: 12/767,095

(22) Filed: Apr. 26, 2010

(65) Prior Publication Data

US 2010/0273396 A1 Oct. 28, 2010

(30) Foreign Application Priority Data

Apr. 27, 2009 (JP) ..... 2009-107656

(51) Int. Cl.
*B24B 1/00* (2006.01)

(52) U.S. Cl. ..... 451/5; 451/6; 451/41; 451/285; 451/286; 451/288

(58) Field of Classification Search ..... 451/5, 6, 451/41, 285–289
See application file for complete search history.

(56) References Cited

U.S. PATENT DOCUMENTS

| | | | | |
|---|---|---|---|---|
| 4,864,779 | A * | 9/1989 | Ozaki | 451/5 |
| 5,888,126 | A * | 3/1999 | Hirose et al. | 451/287 |
| 6,106,369 | A * | 8/2000 | Konishi et al. | 451/41 |
| 6,506,097 | B1 * | 1/2003 | Adams et al. | 451/5 |
| 7,008,295 | B2 * | 3/2006 | Wiswesser et al. | 451/6 |
| 7,025,658 | B2 * | 4/2006 | David | 451/5 |
| 7,300,332 | B2 * | 11/2007 | Kobayashi et al. | 451/5 |
| 7,933,665 | B2 * | 4/2011 | Sakiya et al. | 700/57 |
| 8,112,169 | B2 * | 2/2012 | Kobayashi et al. | 700/108 |
| 2006/0100740 | A1 * | 5/2006 | Sakiya et al. | 700/246 |
| 2007/0243795 | A1 | 10/2007 | Kobayashi et al. | |
| 2012/0088438 | A1 * | 4/2012 | Tada et al. | 451/5 |

FOREIGN PATENT DOCUMENTS

| | | |
|---|---|---|
| JP | 2002-343754 | 11/2002 |
| WO | 00/26609 | 5/2000 |

* cited by examiner

*Primary Examiner* — George Nguyen
(74) *Attorney, Agent, or Firm* — Wenderoth, Lind & Ponack, L.L.P.

(57) ABSTRACT

A method of polishing a substrate includes rotating a polishing table having a polishing surface, holding the substrate by a top ring, bringing the substrate into contact with the polishing surface while swinging and rotating the top ring to polish the substrate, and monitoring a surface condition of the substrate by a monitoring sensor. A rotational speed of the polishing table and conditions of swing motion of the top ring are determined such that a position of the monitoring sensor, a position of a center of rotation of the top ring, and a direction of the swing motion of the top ring at a point of time when a predetermined period of time has elapsed after polishing of the substrate is started approximately coincide with their previous values at a point of time before the predetermined period of time has elapsed.

12 Claims, 17 Drawing Sheets

POLISHING METHOD, POLISHING APPARATUS AND METHOD OF MONITORING A SUBSTRATE

BACKGROUND OF THE INVENTION

1. Field of the Invention

The present invention relates to a polishing method and a polishing apparatus for a workpiece, such as a semiconductor substrate, and also relates to a method of monitoring a substrate. More particularly, the present invention relates to a polishing method, a polishing apparatus, and a substrate monitoring method suitable for use in monitoring a surface condition of the workpiece with a monitoring sensor while swinging a top ring that holds the workpiece to be polished.

2. Description of the Related Art

Fabrication of a highly integrated semiconductor device entails fine interconnects and multilayer structure, which require a surface flatness of a semiconductor substrate (which will be hereinafter referred to as "substrate"). Chemical mechanical polishing (CMP) has been conventionally used to remove surface irregularities of the substrate to provide a flat surface thereof.

In the chemical mechanical polishing procedure, it is necessary to terminate polishing of the substrate at a desired film thickness. For example, there is a case where it is required to leave an insulating layer, such as $SiO_2$, over metal interconnects, such as Cu (copper) or Al (aluminum), in order to form, in a subsequent step, another metal layer on the insulating layer, which is called an interlayer dielectric. In such a case, if polishing is performed more than necessary, sufficient insulation performance cannot be obtained. Therefore, it is necessary to terminate the polishing process so as to leave the interlayer dielectric with a predetermined film thickness.

In the device fabrication procedure, trenches for interconnects in predetermined patterns are formed on a substrate in advance, and the trenches are filled with Cu (or alloy thereof). Subsequently, unwanted portions of Cu on the surface of the substrate are removed by CMP. When polishing the Cu layer by CMP, it is necessary to selectively remove the Cu layer so as to leave Cu only in the trenches for interconnects. Specifically, it is required to remove the Cu layer in regions other than in the trenches until a barrier layer (composed of TaN, for example) is exposed.

Thus, a CMP apparatus typically includes a monitoring sensor for detecting and monitoring a polished condition of a substrate surface during polishing. An end point of the polishing process is determined based on measurements of the monitoring sensor.

It is known that a polishing profile is substantially axisymmetric with respect to an axis extending through a center of rotation of the substrate in a direction perpendicular to a surface to be polished, due to rotation of a top ring that holds the substrate. Therefore, it is important to detect and monitor the polished surface condition by the monitoring sensor in all radial positions on the substrate including a substrate center and substrate edges where some peculiarities, such as excessive polishing or insufficient polishing, are likely to occur.

FIG. 18 is a view showing a positional relationship between a polishing table 500 and a substrate 550 in a CMP apparatus. As shown in this figure, the CMP apparatus is configured to hold and rotate the substrate 550 by a top ring and bring the substrate into contact with a surface (i.e., a polishing surface) 501 of the rotating polishing table 500, thereby polishing a surface (i.e., a surface to be polished) of the substrate 550 uniformly. The monitoring sensor is mounted on the polishing table 500 at a predetermined location. Specifically, the monitoring sensor is situated at a predetermined point in a sensor locus 11 indicated by a dashed line in FIG. 18. The monitoring sensor detects the polished condition of the surface of the substrate 550 when the monitoring sensor is positioned under the substrate 550.

This CMP apparatus polishes the substrate 550 while rotating and oscillating the substrate 550 by swinging the top ring during polishing of the substrate 550. Specifically, the substrate 550 is moved between a position indicated by a solid line and a position indicated by a dotted line in FIG. 18. When monitoring the surface of the substrate 550 by the monitoring sensor, a rotation angle of the polishing table 500 (i.e., a rotation angle of the monitoring sensor) is detected in each revolution of the polishing table 500, so that signal from the monitoring sensor is monitored focusing on measuring points, i.e., black points al shown in FIG. 18, where the monitoring sensor moves under the substrate 550 every time the polishing table 500 makes one revolution regardless of the swinging position of the top ring.

In such a polishing procedure, however, the monitoring sensor cannot monitor all of the measuring points on the substrate (i.e., cannot monitor white points a2 in FIG. 18 and the center of the substrate when the substrate is located as indicated by the dotted line). Specifically, it is difficult to monitor the substrate center and the substrate edges, and stable monitoring data cannot be obtained.

Further, since the top ring is swung, the radial position of the measuring point with respect to the substrate surface varies every time the polishing table 500 makes a revolution, making it difficult to perform consistent and stable monitoring of the substrate during polishing. This is particularly problematic in a case of performing real-time controlling of a polishing profile based on the monitoring data, because it is necessary to grasp an accurate film-thickness profile in each radial position during polishing.

SUMMARY OF THE INVENTION

The present invention has been made in view of the above drawbacks. It is therefore an object of the present invention to provide a polishing method, a polishing apparatus, and a substrate monitoring method capable of obtaining stable monitoring data of a surface of a substrate during polishing thereof and capable of easily monitoring a center and edges of the surface of the substrate.

An aspect of the present invention provides a method of polishing a substrate, comprising: rotating a polishing table having a polishing surface, a monitoring sensor being mounted on the polishing table; holding a substrate by a top ring; bringing the substrate into contact with the polishing surface while swinging and rotating the top ring to polish the substrate; and monitoring a surface condition of the substrate by the monitoring sensor during polishing of the substrate. A rotational speed of the polishing table and conditions of swing motion of the top ring are determined such that a position of the monitoring sensor, a position of a center of rotation of the top ring, and a direction of the swing motion of the top ring at a point of time when a predetermined period of time has elapsed after polishing of the substrate is started approximately coincide with their previous values at a point of time before the predetermined period of time has elapsed.

In a preferred aspect of the present invention, a polishing time for the substrate is at least three times the predetermined period of time.

In a preferred aspect of the present invention, the method further includes: performing a predetermined arithmetic process on signal from the monitoring sensor to create monitoring signal; and controlling a pressing force of the top ring applied to the substrate, based on the monitoring signal.

In a preferred aspect of the present invention, an integral multiple of the predetermined period of time is equal to a period of a moving average for smoothing monitoring data.

In a preferred aspect of the present invention, the swing motion of the top ring is started in synchronization with rotation of the polishing table.

In a preferred aspect of the present invention, the method further includes: calculating a central position of the top ring during polishing of the substrate; and determining a distance of a measuring point of the monitoring sensor from a substrate center.

In a preferred aspect of the present invention, the method further includes: establishing synchronization between the rotation of the polishing table and the swing motion of the top ring each time the predetermined period of time elapses.

In a preferred aspect of the present invention, the top ring is swung such that the monitoring sensor passes approximately through the center of the top ring at least one time during the predetermined period of time.

In a preferred aspect of the present invention, the top ring has concentric plural zones capable of pressing the substrate with independently adjusted forces, and an amplitude of the swing motion of the top ring is determined such that the monitoring sensor passes through the innermost zone each time the polishing table makes one revolution.

In a preferred aspect of the present invention, the monitoring is performed using a moving average of monitoring data with respect to each zone of the top ring, and the monitoring data are obtained under a condition that a locus of the center of the top ring performing the swing motion contacts a locus of the monitoring sensor when monitoring the substrate and on an assumption that the top ring does not perform the swing motion.

Another aspect of the present invention provides an apparatus for polishing a substrate, including: a polishing table having a polishing surface, the polishing table being rotatable; a top ring configured to hold a substrate and bring the substrate into contact with the polishing table while swinging and rotating the substrate; a monitoring sensor configured to detect a surface condition of the substrate during polishing of the substrate, the monitoring sensor being mounted on the polishing table; and a controller configured to control swing motion and rotation of the top ring and control rotation of the polishing table. The controller is further configured to control the rotation of the polishing table and the swing motion of the top ring such that a position of the monitoring sensor, a position of a center of the rotation of the top ring, and a direction of the swing motion of the top ring at a point of time when a predetermined period of time has elapsed after polishing of the substrate is started approximately coincide with their previous values at a point of time before the predetermined period of time has elapsed.

Still another aspect of the present invention provides a method of monitoring a substrate, including: rotating a polishing table having a polishing surface, a monitoring sensor being mounted on the polishing table so as to face the polishing surface of the polishing table; holding the substrate by a top ring; bringing the substrate into contact with the polishing surface while swinging and rotating the top ring to polish the substrate through relative motion between the top ring and the polishing table; and monitoring a surface condition of the substrate by the monitoring sensor during polishing of the substrate while controlling a radial distance of a locus of the monitoring sensor described on a surface, to be polished, of the substrate from a center of the substrate.

In a preferred aspect of the present invention, the method further includes: determining a ratio of a swing period of the top ring to a rotation period of the polishing table to establish a distribution of loci of the monitoring sensor.

The method and apparatus according to the present invention as described above can obtain non-biased and stable monitoring data that reflect film thicknesses in respective points on the surface of the substrate during polishing of the substrate.

DETAILED DESCRIPTION OF THE PREFERRED EMBODIMENTS

Figure 1:
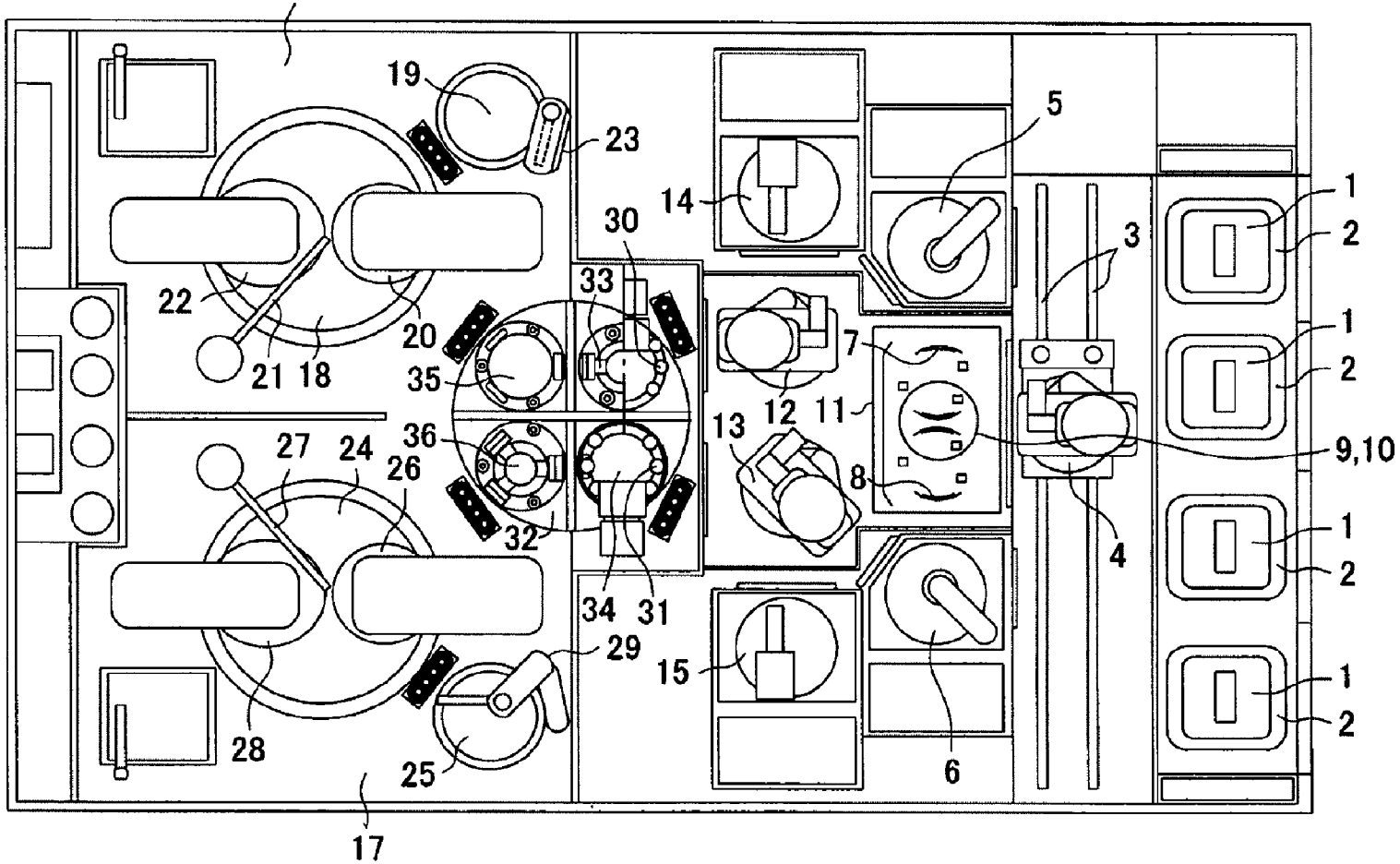
FIG. 1 is a plan view showing a polishing apparatus.

Embodiments of the present invention will be described below in detail with reference to the drawings. FIG. 1 is a plan view showing layout of a polishing apparatus to which the present invention is applied. As shown in FIG. 1, the polishing apparatus has four loading and unloading stages 2 each for receiving a wafer cassette 1 that stores a number of semiconductor wafers therein. Moving mechanisms 3 are provided along an arrangement direction of the loading and unloading stages 2. A first transfer robot 4, having two hands, is provided on the moving mechanisms 3. The hands of the first transfer robot 4 can access each of the wafer cassettes 1 on the loading and unloading stages 2.

Two cleaning and drying machines 5 and 6 are disposed at an opposite side of the wafer cassettes 1 with respect to the moving mechanisms 3 of the transfer robot 4. The hands of the first transfer robot 4 can also access the cleaning and drying machines 5 and 6. Each of the cleaning and drying machines 5 and 6 has a spin-dry function for drying a wafer by spinning it at a high speed. A wafer station 11, having four racks 7, 8, 9, and 10 on which wafers are placed respectively, is disposed between the two cleaning and drying machines 5 and 6. The hands of the first transfer robot 4 can also access the wafer station 11.

A second transfer robot 12, having two hands, is disposed at a position where the hands of the second transfer robot 12 can access the cleaning and drying machine 5 and the three racks 7, 9, and 10. A third transfer robot 13, having two hands, is disposed at a position where the hands of the third transfer robot 13 can access the cleaning and drying machine 6 and the three supports 8, 9, and 10. The rack 7 is used to receive a wafer when transporting the wafer between the first transfer robot 4 and the second transfer robot 12, and the rack 8 is used to receive a wafer when transporting the wafer between the first transfer robot 4 and the third transfer robot 13. The rack 9 is used for transporting a wafer from the second transfer robot 12 to the third transfer robot 13, and the rack 10 is used for transporting a wafer from the third transfer robot 13 to the second transfer robot 12. The rack 9 is located above the rack 10.

A cleaning machine 14 for cleaning a polished wafer is disposed adjacent to the cleaning and drying machine 5 and accessible by the hands of the second transfer robot 12. A cleaning machine 15 for cleaning a polished wafer is disposed adjacent to the cleaning and drying machine 6 and accessible by the hands of the third transfer robot 13.

As shown in FIG. 1, the polishing apparatus includes two polishing units 16 and 17. Each polishing unit has two polishing tables and a single top ring for holding a wafer and pressing the wafer against the polishing tables to polish the wafer. Specifically, the polishing unit 16 includes a first polishing table 18, a second polishing table 19, a top ring 20, a polishing liquid supply nozzle 21 for supplying a polishing liquid onto the first polishing table 18, a dresser 22 for dressing the first polishing table 18, and a dresser 23 for dressing the second polishing table 19. The polishing unit 17 includes a first polishing table 24, a second polishing table 25, a top ring 26, a polishing liquid supply nozzle 27 for supplying a polishing liquid onto the first polishing table 24, a dresser 28 for dressing the first polishing table 24, and a dresser 29 for dressing the second polishing table 25.

The polishing unit 16 has a reversing machine 30 for reversing the wafer. This reversing machine 30 is located at a position accessible by the hands of the second transfer robot 12, so that the wafer is transported to the reversing machine 30 by the second transfer robot 12. Similarly, the polishing unit 17 has a reversing machine 31 for reversing the wafer. This reversing machine 31 is located at a position accessible by the hands of the third transfer robot 13, so that the wafer is transported to the reversing machine 31 by the third transfer robot 13.

A rotary transporter 32 for transporting the wafer between the reversing machines 30 and 31 and the top rings 20 and 26 is disposed below the reversing machines 30 and 31 and the top rings 20 and 26. The rotary transporter 32 has four stages for wafers at equal intervals and a plurality of wafers can be placed onto the stages simultaneously. The wafer is transported to the reversing machine 30 or 31, and then transported onto the rotary transporter 32 by a lifter 33 or 34 disposed under the rotary transporter 32. Specifically, the lifter 33 moves upwardly and downwardly when the center of the stage of the rotary transporter 32 coincides in phase with the center of the wafer chucked by the reversing machine 30 to thereby transfer the wafer from the reversing machine 30 to the rotary transporter 32. Similarly, the lifter 34 moves upwardly and downwardly when the center of the stage of the rotary transporter 32 coincides in phase with the center of the wafer chucked by the reversing machine 31 to thereby transfer the wafer from the reversing machine 31 to the rotary transporter 32.

The wafer, transported to the top ring 20, is vacuum-chucked by a vacuum suction mechanism of the top ring 20 and the wafer is transported to the polishing table 18, with being attracted to the top ring. Then, the wafer is polished by a polishing surface composed of a polishing pad or a grinding stone or the like mounted on the polishing table 18. The second polishing table 19 is disposed at a position accessible by the top ring 20. With this arrangement, after the wafer is polished by the first polishing table 18, this wafer can be further polished by the second polishing table 19. The polished wafer is returned to the reversing machines 30 or 31 via the same route as described above.

Similarly, the wafer, transported to the top ring 26, is vacuum-chucked by a vacuum suction mechanism of the top ring 26 and the wafer is transported to the polishing table 24, with being attracted to the top ring. Then, the wafer is polished by a polishing surface composed of a polishing pad or a grinding stone or the like mounted on the polishing table 24. The second polishing table 25 is disposed at a position accessible by the top ring 26. With this arrangement, after the wafer is polished by the first polishing table 24, this wafer can be further polished by the second polishing table 25. The polished wafer is returned to the reversing machines 30 or 31 via the same route as described above.

The wafer, returned to the reversing machine 30 or 31, is then transported by the second transfer robot 12 or the third transfer robot 13 to the cleaning machine 14 or 15, where the wafer is cleaned. The wafer, cleaned by the cleaning machine 14 or 15, is transported by the second transfer robot 12 or the third transfer robot 13 to the cleaning machine 5 or 6, where the wafer is cleaned and dried. The wafer, cleaned and dried by the cleaning machine 5 or 6, is placed onto the rack 7 or 8 by the second transfer robot 12 or the third transfer robot 13 and returned to the wafer cassette 1 on the loading and unloading stage 2 by the first transfer robot 4.

Next, the above-described polishing unit will be further described in detail. Since the polishing unit 16 and the polishing unit 17 have the same structure, only the polishing unit 16 will be described below. It is noted that the following explanations can be applied to the polishing unit 17 as well.

Figure 2:
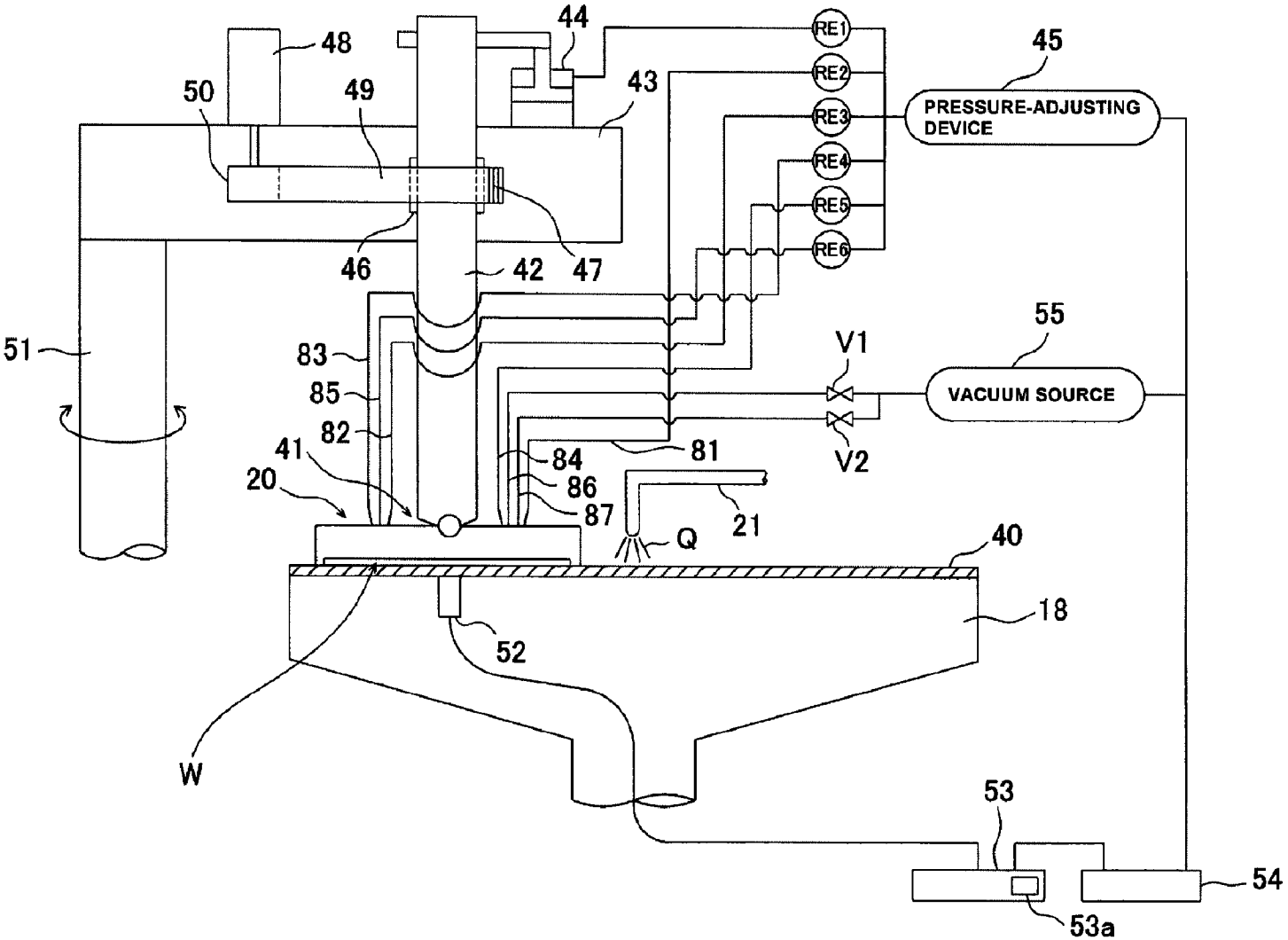
FIG. 2 is a schematic view showing part of a polishing unit shown in FIG. 1.

FIG. 2 is a schematic view showing a part of the polishing unit (i.e., polishing apparatus) 16 shown in FIG. 1. As shown in FIG. 2, the polishing table 18 is provided below the top ring 20, and a polishing pad 40 is attached to an upper surface of the polishing table 18. The polishing liquid supply nozzle 21 is provided above the polishing table 18 and a polishing liquid Q is supplied onto the polishing pad 40 on the polishing table 18 from the polishing liquid supply nozzle 21. The polishing table 18 is coupled to a motor (not shown) as a drive mechanism for causing relative movement between the polishing table 18 and the top ring 20. The polishing table 18 is rotated by the motor.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single layer). Foam polyurethane is porous and has a large number of fine recesses or holes formed in its surface.

The top ring 20 is coupled to a top ring shaft 42 via a universal joint 41, and the top ring shaft 42 is coupled to a top ring air cylinder 44 secured to a top ring head 43. The top ring 20 is coupled to a lower end of the top ring shaft 42.

The top ring air cylinder 44 is coupled to a pressure-adjusting device 45 via a regulator RE1. This pressure-adjusting device 45 is configured to adjust pressure by supplying pressurized fluid (e.g., pressurized air from a compressed air source) or by developing a vacuum with a pump or the like. The pressure-adjusting device 45 can adjust the pressure of the pressurized fluid to be supplied to the top ring air cylinder 44 through the regulator RE1. The top ring shaft 42 is moved upwardly and downwardly by the top ring air cylinder 44 to thereby elevate and lower the top ring 20 in its entirety and press a below-described retainer ring 61, secured to a top ring body 60, against the polishing table 18 at a predetermined force.

The top ring shaft 42 is coupled to a rotary cylinder 46 via a key (not shown). This rotary cylinder 46 is provided with a timing pulley 47 on its outer periphery. A top ring motor 48, serving as a drive mechanism for causing a relative movement between the polishing table 18 and the top ring 20, is secured to the top ring head 43. The timing pulley 47 is coupled, via a timing belt 49, to a timing pulley 50 provided on the top ring motor 48. With this arrangement, when the top ring motor 48 is set in motion, the rotary cylinder 46 and the top ring shaft 42 are rotated in unison through the timing pulley 50, the timing belt 49, and the timing pulley 47, whereby the top ring 20 is rotated. The top ring head 43 is supported by a top ring head shaft 51 that is rotatably supported by a frame (not shown).

As shown in FIG. 2, a sensor 52 for monitoring (detecting) a substrate condition including a film thickness of a wafer being polished is embedded in the polishing table 18. This sensor 52 is coupled to a monitoring device 53 and a controller 54. Output signal of the sensor 52 is transmitted to the monitoring device 53, where necessary conversion and operation (arithmetic processing) are conducted on the output signal of the sensor 52 to produce a monitoring signal. The monitoring device 53 has a controlling section 53*a* for performing control arithmetic based on the monitoring signal. The controlling section 53*a* is configured to determine a force (pressing force) of the top ring 20 to press the wafer based on the monitoring signal and sends command for the determined pressing force to the controller 54. An eddy-current sensor may be used as the sensor 52. The controller 54, provided outside of the monitoring device 53, sends commands to the pressure-adjusting device 45 upon receiving the commands from the monitoring device 53 so as to change the pressing force of the top ring 20. The controller 54 is configured to control operations of the polishing unit (i.e., polishing apparatus) 16 in its entirety, including the swing motion and the rotation of the top ring 20 and the rotation of the polishing table 18. The controlling section 53*a* of the monitoring device 53 and the controller 54 may be integrated to form a single controller.

Figure 3:
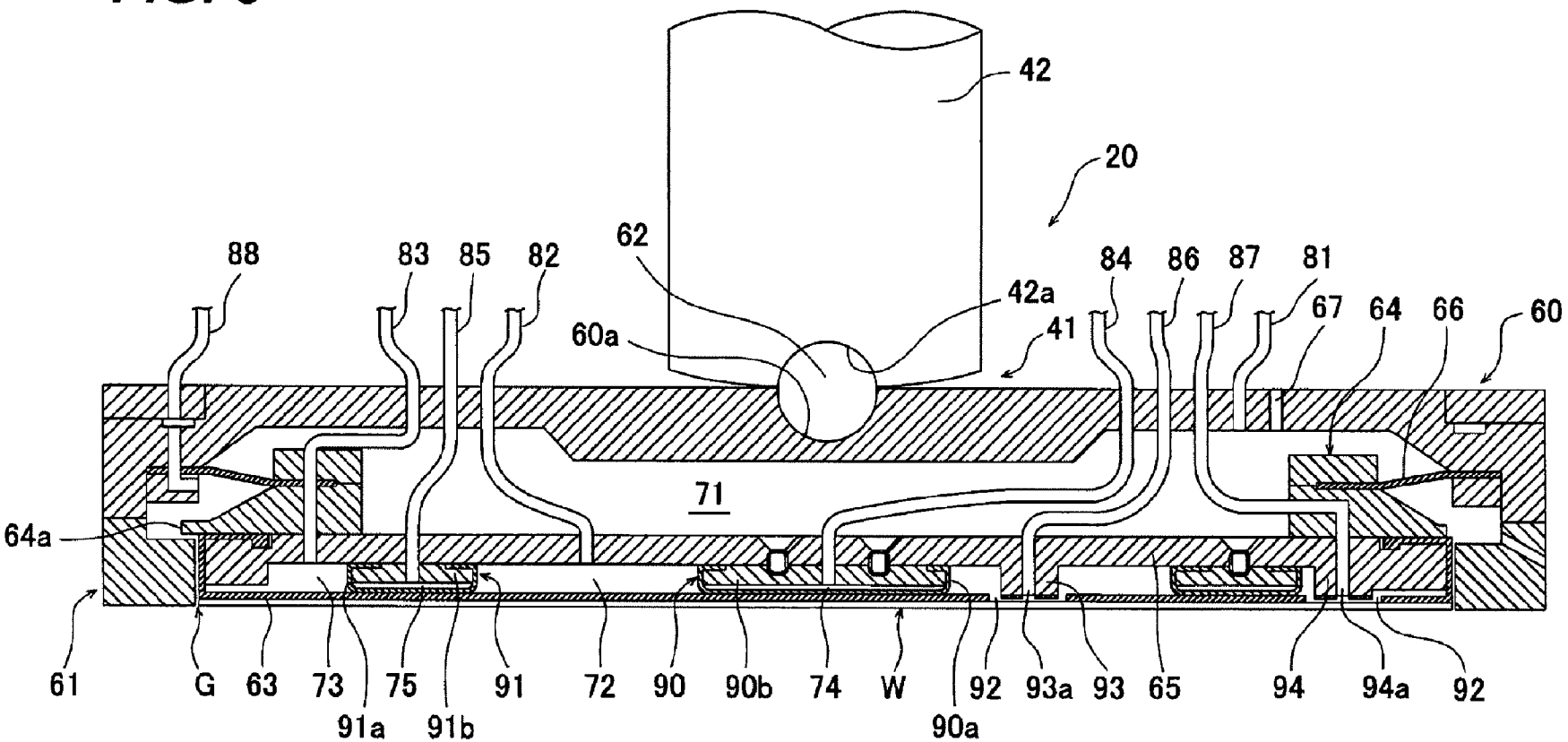
FIG. 3 is a vertical cross-sectional view of a top ring shown in FIG. 2.
Figure 4:
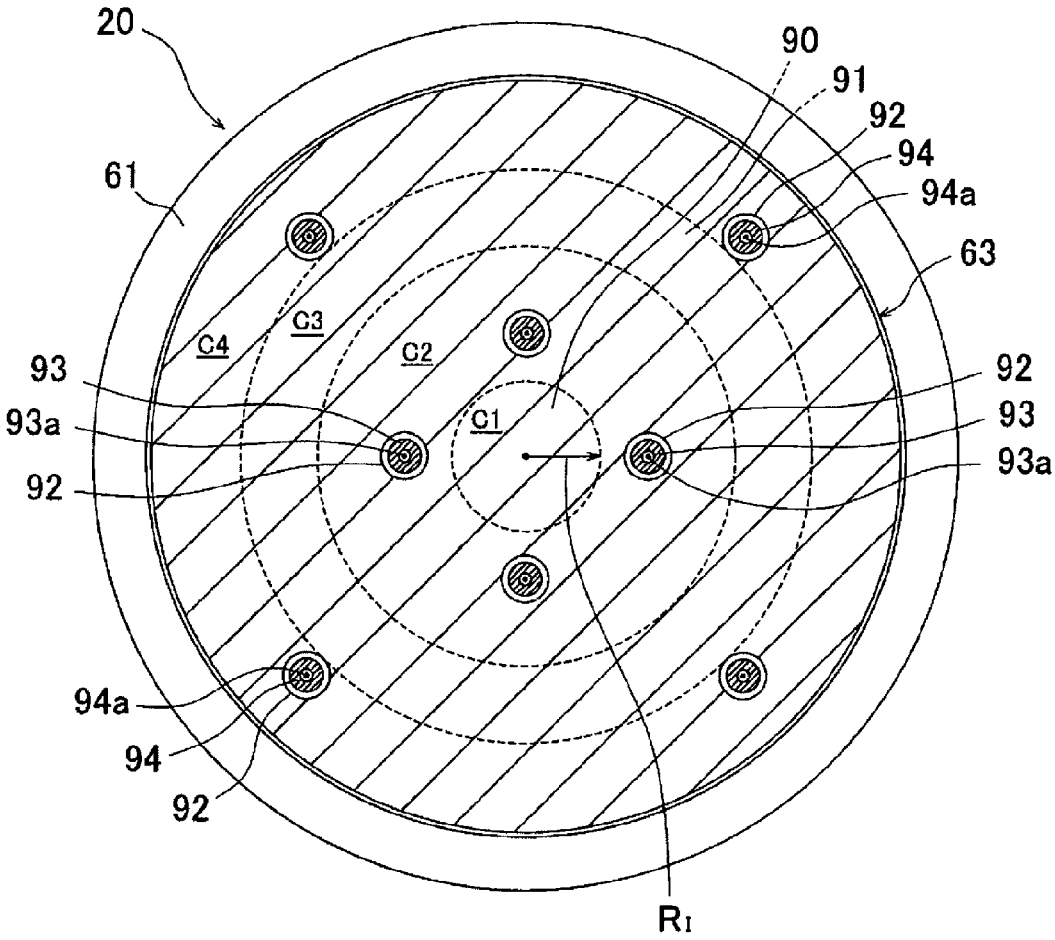
FIG. 4 is a bottom view of the top ring shown in FIG. 2.

FIG. 3 is a vertical cross-sectional view of the top ring 20 shown in FIG. 2, and FIG. 4 is a bottom view of the top ring 20 shown in FIG. 2. As shown in FIG. 3, the top ring 20 has the top ring body 60 in a shape of a cylindrical vessel having a space defined therein, and further has the retainer ring 61 secured to the lower end of the top ring body 60. A lower portion of the retainer ring 61 projects radially inwardly. The top ring body 60 is made of material having high strength and rigidity, such as metal or ceramic. The retainer ring 61 is made of a highly rigid resin, ceramic, or the like. The retainer ring 61 may be formed integrally with the top ring body 60.

The top ring shaft 42 is located above a center of the top ring body 60. The top ring body 60 and the top ring shaft 42 are coupled to each other by the universal joint 41. This universal joint 41 includes a spherical bearing mechanism and a rotation transmitting mechanism. The spherical bearing mechanism is configured to allow the top ring body 60 and the top ring shaft 42 to tilt with respect to each other, and the rotation transmitting mechanism is configured to transmit rotation of the top ring shaft 42 to the top ring body 60. The spherical bearing mechanism and the rotation transmitting mechanism transmit a pressing force and a torque of the top ring shaft 42 to the top ring body 60, while allowing the top ring body 60 and the top ring shaft 42 to tilt relative to each other.

The spherical bearing mechanism includes a hemispheric recess 42*a* formed on a central portion of a lower surface of the top ring shaft 42, a hemispheric recess 60*a* formed on the central portion of the upper surface of the top ring body 60, and a bearing ball 62 interposed between the recesses 42*a* and 60*a*. The bearing ball 62 is made from a high-hardness material, such as ceramic. The rotation transmitting mechanism includes drive pins (not shown) fixed to the top ring shaft 42, and driven pins (not shown) fixed to the top ring body 60. The drive pins and the driven pins are vertically movable relative to each other, even when the top ring body 60 is tilted. Therefore, the drive pins and the driven pins maintain their engagement, with their mutual contact points shifted. The rotation transmitting mechanism thus securely transmits the torque of the top ring shaft 42 to the top ring body 60.

The top ring body 60 and the retainer ring 61 define a space therein in which an elastic pad 63 to be brought into contact with the wafer W, an annular holder ring 64, and a substantially disk-shaped chucking plate 65 for supporting the elastic pad 63 are housed. The elastic pad 63 is sandwiched, at its periphery, between the holder ring 64 and the chucking plate 65. The elastic pad 63 extends radially inwardly so as to cover a lower surface of the chucking plate 65. A space is thus formed between the elastic pad 63 and the chucking plate 65.

The chucking plate 65 may be made of metal. In the case of using the eddy current sensor as the sensor 52 for measuring a thickness of a thin film formed on the wafer W, it is preferable that the chucking plate 65 be made of a non-magnetic material (e.g., a fluorine-based resin, such as tetrafluoroethylene resin) or an insulating material e.g., ceramic, such as SiC (silicon carbide) or $Al_2O_3$ (alumina).

A pressure sheet 66, formed from an elastic membrane, is provided so as to extend between the holder ring 64 and the top ring body 60. A pressure chamber 71 is formed in the top ring body 60. This pressure chamber 71 is defined by the top ring body 60, the chucking plate 65, the holder ring 64, and the pressure sheet 66. A fluid passage 81, which includes a tube and a connector, is provided in fluid communication with the pressure chamber 71. The pressure chamber 71 is coupled to the pressure-adjusting device 45 via a regulator RE2 (see FIG. 2) provided on the fluid passage 81. The pressure sheet 66 is made of a rubber material having excellent strength and durability, such as ethylene-propylene rubber (EPDM), polyurethane rubber, silicon rubber or the like.

A center bag 90 and a ring tube 91, which are brought into contact with the elastic pad 63, are provided in the space formed between the elastic pad 63 and the chucking plate 65. As shown in FIGS. 3 and 4, in this embodiment, the center bag 90 is disposed on the central portion of the lower surface of the chucking plate 65, and the ring tube 91 is disposed radially outwardly of the center bag 90 so as to surround the center bag 90. The elastic pad 63, the center bag 90, and the ring tube 91 are made of rubber having excellent strength and durability such as ethylene-propylene rubber (EPDM), polyurethane rubber, silicon rubber or the like, as well as the pressure sheet 66.

The space formed between the chucking plate 65 and the elastic pad 63 is divided by the center bag 90 and the ring tube 91 into plural chambers: a pressure chamber 72 located between the center bag 90 and the ring tube 91; and a pressure chamber 73 located radially outwardly of the ring tube 91.

The center bag 90 includes an elastic membrane 90*a* that is brought into contact with an upper surface of the elastic pad 63, and a center bag holder 90*b* removably holding the elastic membrane 90*a* at a predetermined position. Inside the center bag 90, a central pressure chamber 74 is defined by the elastic membrane 90*a* and the center bag holder 90*b*. Similarly, the ring tube 91 includes an elastic membrane 91*a* that is brought into contact with the upper surface of the elastic pad 63, and a ring tube holder 91*b* removably holding the elastic membrane 91*a* at a predetermined position. Inside the ring tube 91, an intermediate pressure chamber 75 is defined by the elastic membrane 91*a* and the ring tube holder 91*b*.

Fluid passages 82, 83, 84, and 85, each including a tube and a connector, are provided in fluid communication with the pressure chambers 72, 73, 74, and 75, respectively. The pressure chambers 72, 73, 74, and 75 are coupled to the pressure-adjusting device 45 via regulators RE3, RE4, RE5, and RE6, respectively, provided on the fluid passages 82, 83, 84, and 85. The fluid passages 81-85 are coupled to the respective regulators RE2-RE6 via rotary joints (not shown) provided on an upper end of the top ring shaft 42.

The pressure chamber 71 is located above the chucking plate 65. A pressurized fluid, such as pressurized air, is supplied into or a vacuum is developed in the pressure chambers 71-75 through the fluid passages 81-85 communicating with the respective pressure chambers. As shown in FIG. 2, the pressures of pressurized fluids to be supplied to the pressure chambers 71-75 can be adjusted by the regulators RE2-RE6 provided on the fluid passages 81-85 communicating with the pressure chambers 71-75. The pressures in the pressure chambers 71-75 can thus be controlled independently, and atmospheric pressure or a vacuum can be produced in the pressure chambers 71-75 independently. By changing the pressures in the pressure chambers 71-75 independently through the regulators RE2-RE6, the elastic pad 63 can press the wafer W against the polishing pad 40 with pressing forces adjusted for respective portions (zones) of the wafer W. The pressure chambers 71-75 may be coupled to a vacuum source 55 (see FIG. 2), as desired.

Temperatures of the pressurized fluid to be supplied into the respective pressure chambers 72-75 may be controlled independently, so that the temperature of the substrate can be directly controlled from the opposite side of the surface, to be polished, of the substrate, such as the semiconductor wafer. Especially, by independently controlling the temperatures of the respective pressure chambers, a chemical reaction rate of chemical polishing in CMP can be controlled.

The elastic pad 63, as shown in FIG. 4, has a plurality of openings 92. Inner suction ports 93, projecting downwardly from the chucking plate 65, are provided so as to be exposed from the openings 92 that are arranged between the center bag 90 and the ring tube 91. Outer suction ports 94 are provided so as to be exposed from the openings 92 that are arranged radially outwardly of the ring tube 91. In the present embodiment, the elastic pad 63 has eight openings 92 and the suction ports 93 and 94 are exposed at the respective openings 92.

The suction ports 93 and 94 have communication holes 93*a* and 94*a* communicating with fluid passages 86 and 87, respectively. As shown in FIG. 2, the suction ports 93 and 94 are coupled to the vacuum source 55, such as a vacuum pump, via the fluid passages 86 and 87 and valves V1 and V2. When fluid communication is established between the communication holes 93*a* and 94*a* of the suction ports 93 and 94 and the vacuum source 55, negative pressure is produced in open ends of the communication holes 93*a* and 94*a* and the wafer W is thus attracted (i.e., vacuum-chucked) to lower end surfaces of the suction ports 93 and 94.

As shown in FIG. 3, during polishing of the wafer W, the suction ports 93 and 94 are located above the lower end surface of the elastic pad 63 and therefore do not protrude from the lower end surface of the elastic pad 63. When attracting the wafer W via the vacuum suction, the lower end surfaces of the suction ports 93 and 94 lie in substantially the same plane as the lower end surface of the elastic pad 63.

There is a slight gap G between an outer circumferential surface of the elastic pad 63 and an inner circumferential surface of the retainer ring 61. Therefore, the holder ring 64, the chucking plate 65, and the elastic pad 63 secured to the chucking plate 65 can move vertically relative to the top ring body 60 and the retainer ring 61, and constitute a floating structure capable of moving relative to the top ring body 60 and the retainer ring 61. The holder ring 64 has a plurality of protrusions 64*a* projecting radially outwardly from the outer peripheral surface of its lower portion. These protrusions 64*a* engage an upper surface of a radially-inwardly projecting portion of the retainer ring 61, whereby a downward movement of components, including the above-described holder ring 64, is restricted within a predetermined range.

A fluid passage 88 extends through a peripheral portion of the top ring body 60. A cleaning liquid (e.g., pure water) is supplied to the gap G between the outer circumferential surface of the elastic pad 63 and the inner circumferential surface of the retainer ring 61 through the fluid passage 88.

When the wafer W is to be held by the top ring 20 thus constructed, the fluid communication between the communication holes 93*a* and 94*a* of the suction ports 93 and 94 and the vacuum source 55 is established via the fluid passages 86 and 87. As a result, the wafer W is held on the lower end surfaces of the suction ports 93 and 94 by vacuum suction of the communication holes 93*a* and 94*a*. The top ring 20 is moved while holding the wafer W until the top ring 20 in its entirety is located above the polishing surface (i.e., above the polishing pad 40). A periphery of the wafer W is retained by the retainer ring 61 so that the wafer W is not spun off the top ring 20.

When polishing the wafer W, the vacuum suction of the wafer W by the suction ports 93 and 94 is stopped and the wafer W is held on the lower surface of the top ring 20. The top ring air cylinder 44 is operated to press the retainer ring 61, secured to the lower end of the top ring 20, against the polishing pad 40 of the polishing table 18 at a predetermined force. In this state, the pressurized fluids with predetermined pressures are supplied to the pressure chambers 72-75, respectively. The wafer W is thus pressed against the polishing surface of the polishing table 18. The polishing liquid Q is supplied onto the polishing pad 40 from the polishing liquid supply nozzle 21, and the polishing liquid Q is retained on the polishing pad 40. The wafer W is polished in the presence of the polishing liquid Q between the surface to be polished (i.e., the lower surface) of the wafer W and the polishing pad 40.

Portions of the wafer W that are located below the pressure chambers 72 and 73 are pressed against the polishing surface at pressures of the pressurized fluids supplied to the respective pressure chambers 72 and 73. A portion of the wafer W that is located below the central pressure chamber 74 is pressed, through the elastic membrane 90*a* of the center bag 90 and the elastic pad 63, against the polishing surface at pressure of the pressurized fluid supplied to the pressure chamber 74. A portion of the wafer W that is located below the pressure chamber 75 is pressed, through the elastic membrane 91*a* of the ring tube 91 and the elastic pad 63, against the polishing surface at pressure of the pressurized fluid supplied to the pressure chamber 75.

Therefore, by controlling the pressures of the pressurized fluids to be supplied to the respective pressure chambers 72-75, the polishing pressure (pressing force) applied to the wafer W can be adjusted for each of the wafer portions defined along the radial direction of the wafer W. The polishing pressure (pressing force) for each of the radial portions of the wafer W may be determined in advance by polishing a similar or identical sample wafer (i.e., the same type of wafer) and may be kept constant during polishing. The pressures of the pressurized fluids to be supplied to the respective pressure chambers 72-75 may also be adjusted independently by the controller 54 (see FIG. 2) through the regulators RE3-RE6 based on output of the monitoring sensor 52, so that the polishing pressure (pressing force) to press the wafer W against the polishing pad 40 on the polishing table 18 can be adjusted for each portion of the wafer W In this manner, the wafer W is pressed against the polishing pad 40 on the upper surface of the rotating polishing table 18, with the polishing pressure being adjusted to a desired value for each portion of the wafer W. Similarly, the pressing force of the retainer ring 61 to press the polishing pad 40 can be altered by adjusting, through the regulator RE1, the pressure of the pressurized fluid to be supplied to the top ring air cylinder 44.

In this manner, by appropriately adjusting the pressing force to press the retainer ring 61 against the polishing pad 40 and the pressing forces to press the wafer W against the polishing pad 40 during polishing of the wafer W, a desired distribution of the polishing pressures can be provided over respective zones including a central zone (C1 in FIG. 4), an intermediate zone (C2), an outer zone (C3), a peripheral zone (C4) of the wafer W, and the retainer ring 61 around the wafer W.

In the portion where the wafer W is located below the pressure chambers 72 and 73, there are a portion to which pressing forces are applied from the fluid through the elastic pad 63 and a portion, such as a portion corresponding to the opening 92, where the pressure of the pressurized fluid itself is applied to the wafer W The pressing forces applied to these portions may be equal or may be adjusted to arbitrary forces. Further, during polishing, because the elastic pad 63 is held in tight contact with the rear surface of the wafer W around the opening 92, the pressurized fluids in the pressure chambers 72 and 73 hardly leak to the exterior thereof.

When polishing of the wafer W is terminated, the wafer W is attracted again to the lower end surfaces of the suction ports 93 and 94 via the vacuum suction in the same manner as described above. At this time, supply of the pressurized fluids to the pressure chambers 72-75 is stopped and the pressure chambers 72-75 are vented to atmosphere, so that the lower end surfaces of the suction ports 93 and 94 are brought into contact with the wafer W. Further, the pressure in the pressure chamber 71 is released to the atmospheric pressure, or negative pressure is developed in the pressure chamber 71. This is because, if the pressure of the pressure chamber 71 is kept high, only portions of the wafer W that are held in contact with the suction ports 93 and 94 are strongly pressed against the polishing surface. Therefore, it is necessary to reduce the pressure of the pressure chamber 71 promptly. As shown in FIG. 3, a relief port 67, extending from the pressure chamber 71 through the top ring body 60, may be provided, so that the pressure of the pressure chamber 71 can be reduced quickly. In this structure having the relief port 67, it is necessary to supply the pressurized fluid continuously from the fluid passage 81 when pressurizing the pressure chamber 71. The relief port 67 has a check valve that can prevent an outside air from entering the pressure chamber 71 when negative pressure is created in the pressure chamber 71.

After vacuum-attracting the wafer W as described above, the top ring 20 in its entirety is moved to a transfer position of the wafer W and a fluid (e.g., a compressed air or a mixture of nitrogen and pure water) is ejected to the wafer W from the communication holes 93*a* and 94*a* to thereby release the wafer W from the top ring 20.

Figure 5:
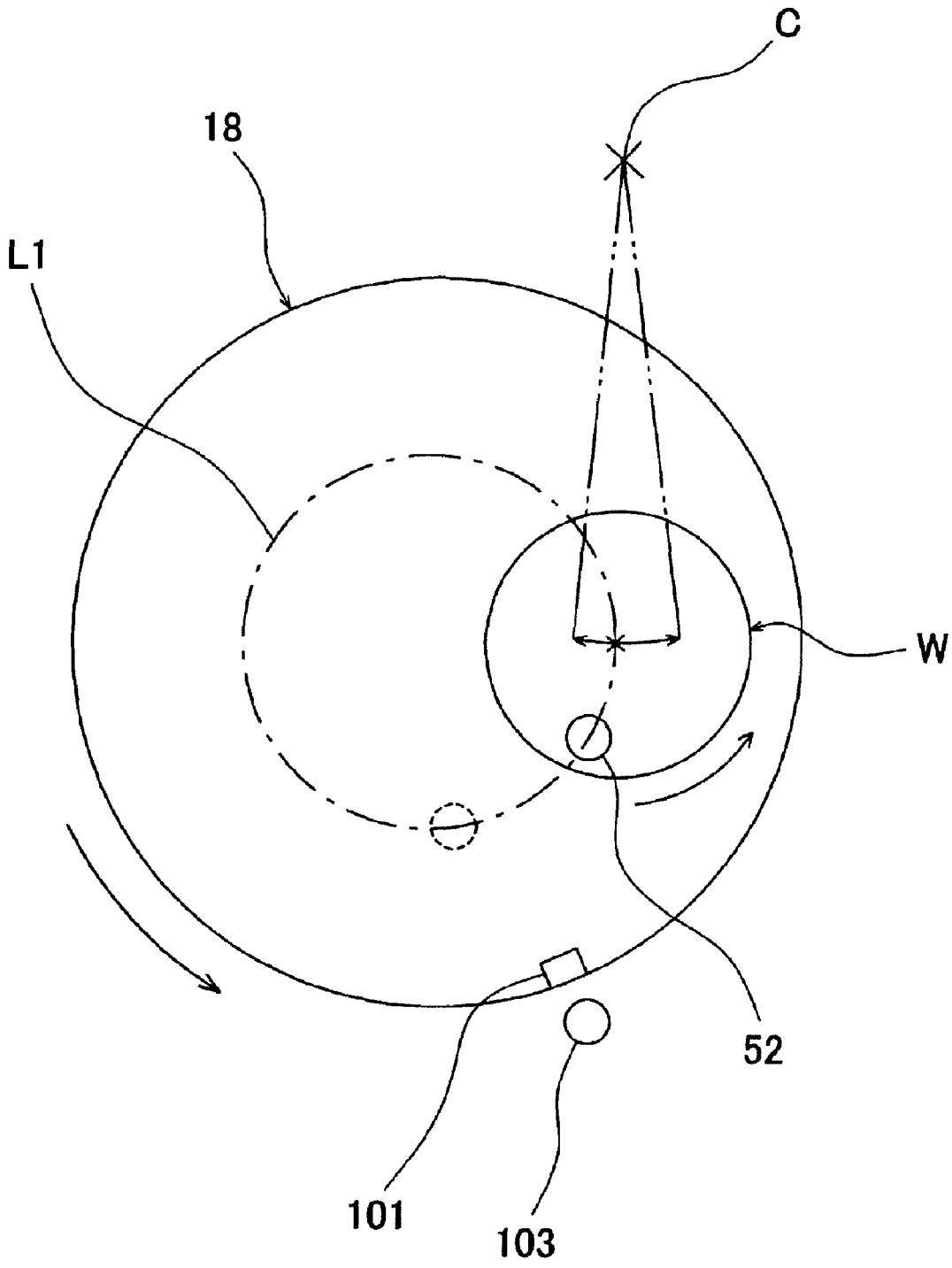
FIG. 5 is a schematic plan view showing a positional relationship between a polishing table and a substrate.

FIG. 5 is a schematic plain view showing a positional relationship between the polishing table 18 and a semiconductor wafer (which will be hereinafter referred to as a "substrate") W. In this example shown in FIG. 5, the polishing table 18 rotates in a counterclockwise direction and the substrate W also rotates in the counterclockwise direction. Further, the top ring 20 swings about a swing center C through a predetermined angle. The monitoring sensor 52 rotates on a locus L1 as the polishing table 18 rotates. Therefore, the monitoring sensor 52 can detect the substrate condition (e.g., a film thickness of the substrate W) when the monitoring sensor 52 lies under the substrate W.

Further, as shown in FIG. 5, in order to determine a rotation angle of the polishing table 18, a proximity sensor 101 is provided on the polishing table 18 (which is a rotating system) and a sensor target 103 is provided on a static member (which is a static system) outside the polishing table 18. Either the proximity sensor 101 or the sensor target 103 may be mounted on the polishing table 18. The device for determining the rotation angle of the polishing table 18 is not limited to the proximity sensor 101 and the sensor target 103, and other various types of device and method, such as a rotary encoder, may be used.

Figure 6:
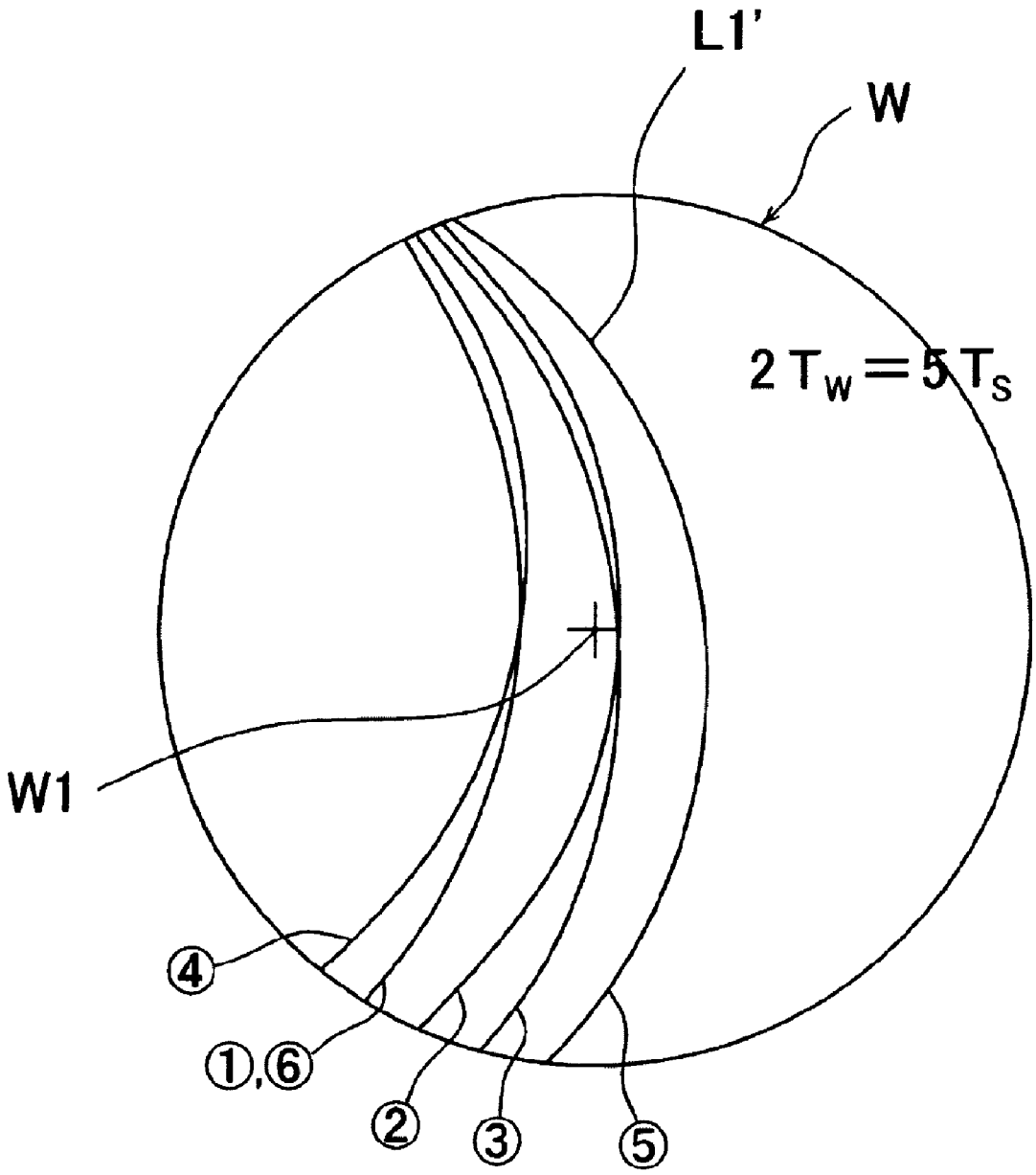
FIG. 6 is a view showing examples of a sensor-in-substrate loci L1' when polishing the substrate by the structures shown in FIG. 5.

FIG. 6 is a view showing examples of a locus L1' (which will be hereinafter referred to as "sensor-in-substrate locus") of the monitoring sensor 52 in the substrate W when the substrate W is polished in the arrangement shown in FIG. 5. The sensor-in-substrate locus represents a locus of the sensor on a coordinate system fixed to the surface of the substrate W. In the following descriptions, in order to make it easier to understand a distance from a substrate center W1 to each locus (i.e., a radial position of each locus), it is assumed that the rotation of the top ring 20 is virtually stopped, i.e., the rotational speed of the top ring 20 is zero. Further, it is assumed that the top ring 20 swings around the swing center C at basically a constant rotational speed and that the top ring 20 reduces its speed at a constant acceleration near turn-around points of its swing motion, changes its direction, and increases its speed.

In FIG. 6, letting $T_S$ be a rotation period of the polishing table 18 and letting $T_W$ be a swing period of the top ring 20, an equation $mT_W=nT_S$ holds (where m and n are relatively prime natural numbers). Thus, when the polishing table 18 makes n revolutions, the monitoring sensor 52 and the substrate center W1 return to their original relationship in position.

Specifically, FIG. 6 shows the sensor-in-substrate loci L1' of the monitoring sensor 52 that passes under the substrate W for a first time to a sixth time in the case where m is 2 and n is 5. As shown in FIG. 6, if $2T_W=5T_S$, then the monitoring sensor 52 scans the equal radial position on the substrate W each time the polishing table 18 makes five revolutions. In this manner, when the monitoring sensor 52 is controlled so as to scan the equal radial position on the substrate W at least one time within a polishing time for one substrate W, a removal rate can be estimated from monitoring data regardless of a variation in film thickness in the radial direction of the substrate W. In other words, the rotational speed of the polishing table 18 and conditions of the swing motion of the top ring 20 are determined such that the position of the monitoring sensor 52, the position of the rotational center of the top ring 20, and the swinging direction of the top ring 20 at a point of time when a predetermined period of time has elapsed after polishing of the substrate W is started approximately coincide with their previous values at a point of time before the above-mentioned predetermined period of time has elapsed.

Figure 7:
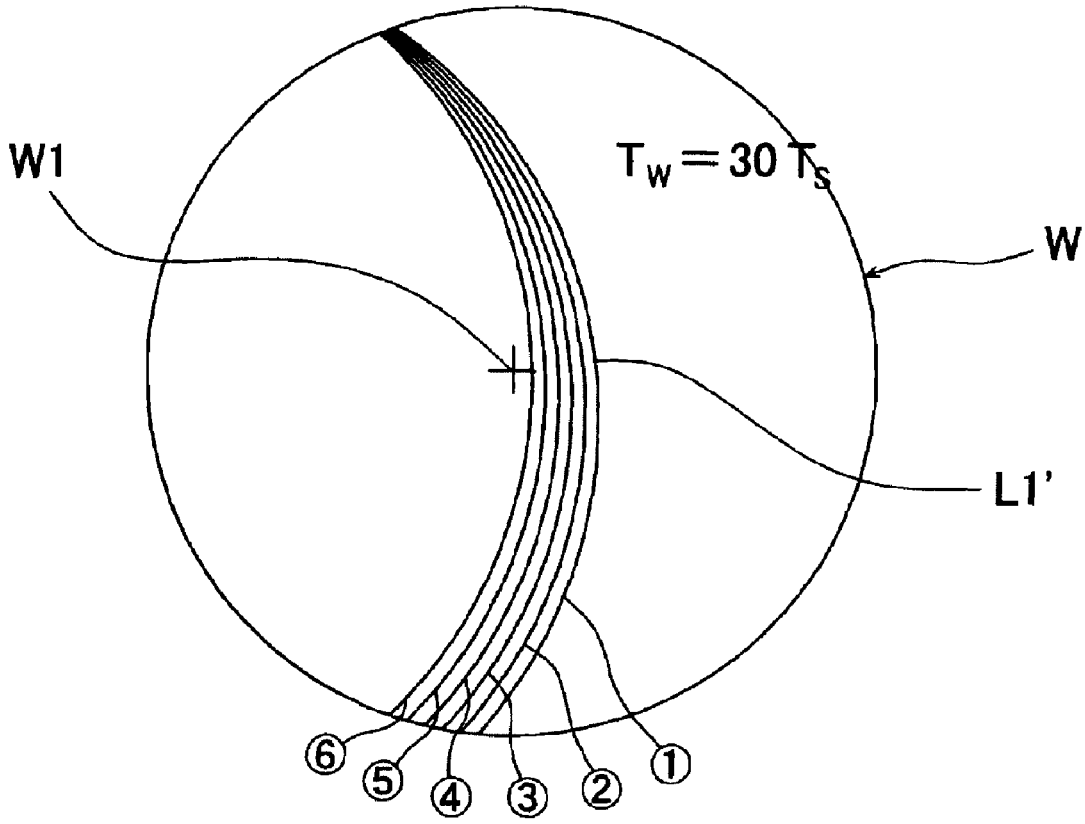
FIG. 7 is a view showing another example of the sensor-in-substrate loci L1' when polishing the substrate by the structures shown in FIG. 5.

FIG. 7 shows the sensor-in-substrate loci L1' of the monitoring sensor 52 that passes under the substrate W for a first time to a sixth time in the case where m is 1 and n is 30. As in this example, when $T_W$ is much larger than $T_S$, the sensor-in-substrate locus L1' is shifted gradually on the surface of the substrate with the rotation of the polishing table 18 and it takes a long time for the sensor-in-substrate locus L1' to return to its original position (although the sensor-in-substrate locus L1' certainly returns to the original position after a long period of time has passed). If the polishing time is shorter than a time required for the polishing table 18 to make thirty revolutions, the monitoring sensor 52 cannot scan the equal radial position on the substrate W again within the polishing time for one substrate. That is, depending on timing, the monitoring sensor 52 scans regions away from the substrate center W1 for a long time. As a result, biased information that does not reflect various radial positions on the surface of the substrate is obtained and stable monitoring of polishing progress cannot be performed.

Thus, in the present embodiment, the top ring 20 and the polishing table 18 are moved relative to each other, while controlling a radial distance of the locus of the monitoring sensor 52 on the surface of the substrate W from the substrate center W1 (i.e., a distance of the locus away from the substrate center W1 in the radial direction of the substrate W, i.e., a radial position). The substrate W is monitored while being polished. A distribution of the loci of the monitoring sensor 52 is established by determining a ratio of a swing period of the top ring 20 to a rotation period of the polishing table 18.

In the above-described embodiment, it is preferable that the monitoring sensor 52 scan the equal radial position on the substrate W three times or more during the polishing time of one substrate W, from a viewpoint of stable monitoring of the polishing progress. More specifically, it is preferable that the polishing time be at least three times the above-mentioned predetermined period of time. With this operation, monitoring data can be obtained three times or more during polishing with respect to a scanning line in the same radial position. Therefore, situation of the polishing progress, such as a trend of change in the removal rate, can be monitored in more detail.

The measuring points on the surface of the substrate may be divided into one or more radial zones (e.g., the zones C1, C2, C3, and C4 in the shape of circle or doughnut as shown in FIG. 4) and characteristic values with respect to the respective radial zones may be calculated for monitoring of the substrate. Alternatively, the monitoring of the condition of the polished surface may focus on a measuring point on a particular order during scanning of the substrate. As described above, the radial position of each measuring point coincides with its original position every time the polishing table 18 makes n revolutions. Therefore, the difference in the radial position in each revolution of the polishing table 18 can be cancelled by calculating a moving average of the characteristic values with respect to n revolutions (or an integral multiple thereof) of the polishing table 18. Specifically, a moving average of the monitoring data, obtained from the monitoring sensor 52 during polishing of the substrate, with respect to the number of revolutions corresponding to the first integer n (or the integral multiple thereof) of the polishing table 18 is calculated. More specifically, the integral multiple of the above-described predetermined period of time is set to be equal to a period of the moving average for smoothing the monitoring data. Through these operations, the difference in the radial position in each revolution of the polishing table 18 can be cancelled, and stable monitoring data can be obtained.

As shown in FIG. 4, the pressing forces applied to the substrate W from the top ring 20 shown in FIG. 1 may vary in the respective plural concentric zones C1, C2, C3, and C4 in this example, so that the substrate W can be pressed against the polishing table 18 with optimal pressing forces for the respective zones C1, C2, C3, and C4. As described above, in the polishing process of the substrate W, a polishing profile is substantially axisymmetric with respect to an axis extending through the center of rotation of the substrate W in the direction perpendicular to the surface to be polished, due to rotation of the top ring 20 that holds the substrate W. For this reason, the different pressing forces are applied independently at the concentric zones C1, C2, C3, and C4 (of course, the pressing forces may be equal to each other).

Further, when performing real-time control for operating the pressing forces for the respective zones C1, C2, C3, and C4 based on the monitoring data during polishing, it is possible, as one example, to polish the same type of substrate in advance under the same polishing conditions to create reference signals for the respective zones arranged in the radial direction of the substrate W based on the monitoring signals and operate the pressing forces during polishing of the product substrate W such that the monitoring signal obtained in each zone converges on or coincides with each reference signal established for each zone. By polishing the same type of substrate (which is a sample substrate with identical or similar structure) beforehand under the same polishing conditions to establish the reference signals for the respective zones in this manner, real-time profile control can be realized.

In the case of the profile control, it is especially important to obtain monitoring data that are not biased with respect to the radial position of the substrate W. Thus, the operating conditions of the polishing table 18 and the top ring 20 are determined such that the monitoring sensor 52 scans the equal radial position on the substrate W three times or more within a polishing time for one substrate W, as discussed above. Operating (changing) of the polishing pressure based on the monitoring data is started after the above-described predetermined period of time has elapsed from the starting of polishing, and is repeated at appropriate cycles thereafter. While the period of the moving average for the monitoring data and the characteristic values is preferably an integral multiple of the above-described predetermined period of time, a control cycle does not necessarily correspond to the above-described predetermined period of time.

Figure 8:
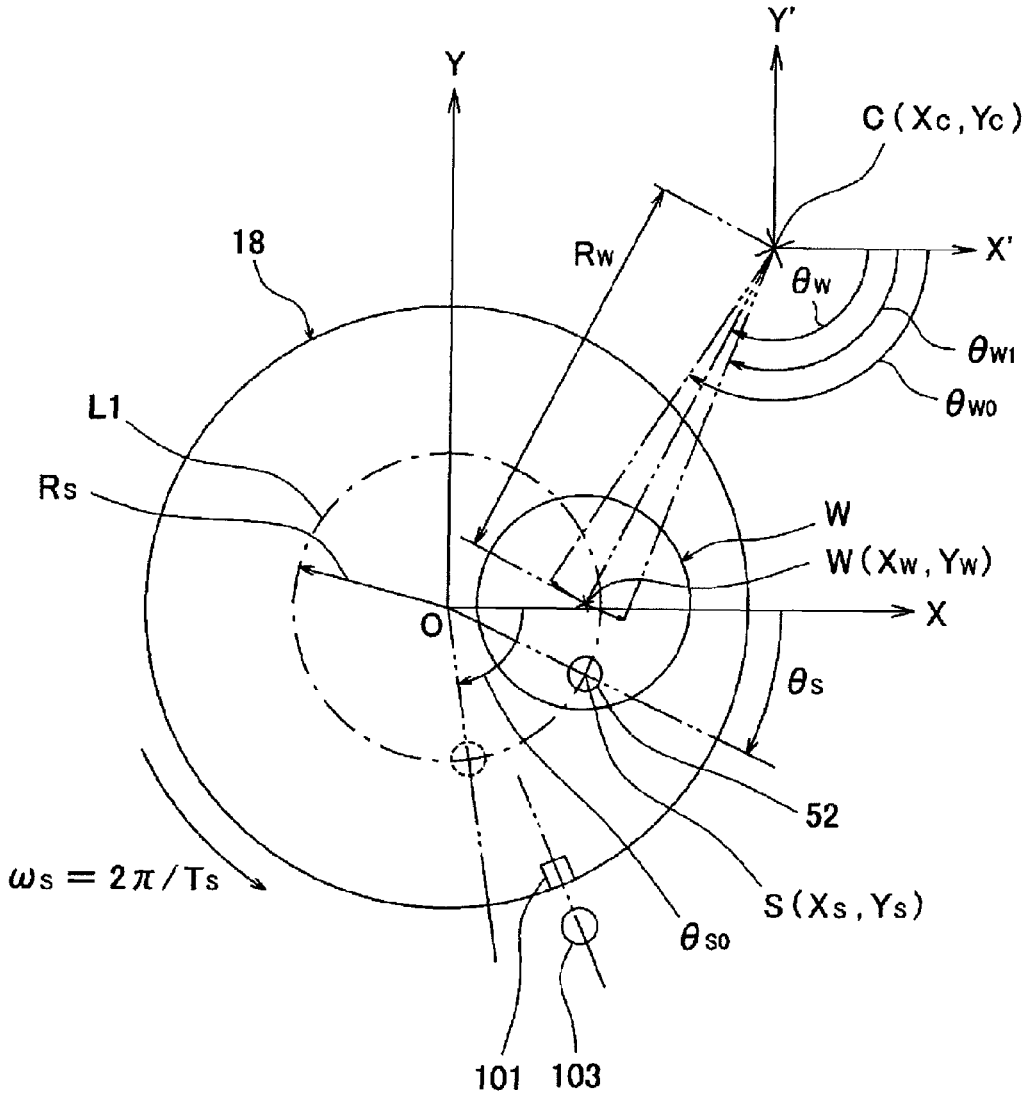
FIG. 8 is a schematic plan view showing the positional relationship between the polishing table and the substrate using a coordinate system.

FIG. 8 is a schematic plan view showing the positional relationship between the polishing table 18 and the substrate W on a coordinate system. An X-Y coordinate system is defined with its origin O on the center of the polishing table 18. It is assumed that the polishing table 18 rotates at a constant speed in the counterclockwise direction. Letting $T_S$ be the rotation period of the polishing table 18, letting $t_0$ be a point of time when the proximity sensor 101 senses the sensor target 103, and letting $\theta_{S0}$ be a rotational angle of the monitoring sensor 52 at the time of $t_0$, the rotational angle $\theta_S$ of the monitoring sensor 52 at a time oft is expressed as $$\theta_s=\theta_{S0}+\omega_S(t-t_0) \tag{1}$$

where $\omega_S=2\pi/T_S$.

In FIG. 8, it is noted that the rotational angles $\theta_S$ and $\theta_{S0}$ of the monitoring sensor 52 and the swing angles $\theta_W$, $\theta_{W0}$, and $\theta_{W1}$ of the substrate W are all negative.

Letting $R_S$ be a radius of the locus L1 of the monitoring sensor, a position $(X_S, Y_S)$ of the monitoring sensor 52 is given by $$X_S=R_S\cos\theta_S,\ Y_S=R_S\sin\theta_S \tag{2}$$

Figure 9:
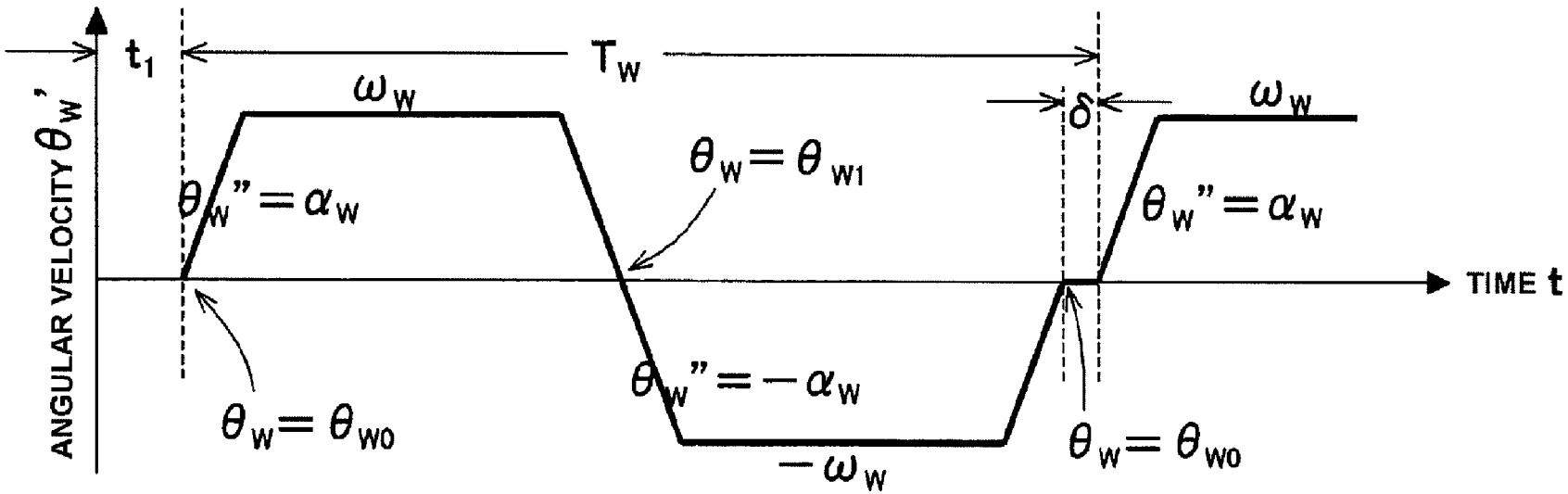
FIG. 9 is a view showing the manner of a change in angular velocity θW' of the top ring.

In FIG. 9, $T_W$ represents a period of the swing motion of the top ring 20. As shown in FIG. 9, the top ring 20 takes the minimum angle $\theta_{W0}$ at a time $t_1$, accelerates at an angular acceleration $\alpha_W$, rotates at a constant angular velocity $\omega_W$, decelerates at an angular acceleration $-\alpha_W$ to reach the maximum angle $\theta_{W1}$, accelerates, rotates at a constant angular velocity $-\omega_W$, and decelerates at an angular acceleration $\alpha_W$ to return to the minimum angle $\theta_{W0}$. Further, the top ring 20 stops for a very short adjustment time $\delta$ at the minimum angle $\theta_{W0}$ and then repeats the same motions as described above. The adjustment time $\delta$ may be zero as a particular case.

Where m is a certain integer that is zero or more and a symbol "'" represents time differential, the following equation holds.

$$T_W=2(\theta_{W1}-\theta_{W0})/\omega_W+2\omega_W/\alpha_W+\delta$$

If $t_1\leqq t-mT_W\leqq t_1+\omega_W/\alpha_W$, then $$\theta_W'=\alpha_W(t-mT_W-t_1)$$

$$\theta_W=\theta_{W0}+\alpha_W(t-mT_W-t_1)^2/2$$

If $t_1+\omega_W/\alpha_W\leqq t-mT_W\leqq t_1+(\theta_{W1}-\theta_{W0})/\omega_W$, then $$\theta_W'=\omega_W$$

$$\theta_W=\theta_{W0}-\omega_W^2/2\alpha_W+\omega_W(t-mT_W-t_1) \tag{3}$$

If $t_1+(\theta_{W1}-\theta_{W0})/\omega_W\leqq t-mT_W\leqq t_1+(\theta_{W1}-\theta_{W0})/\omega_W+2\omega_W/\alpha_W$, then $$\theta_W'=\omega_W-\alpha_W[t-mT_W-t_1-(\theta_{W1}-\theta_{W0})/\omega_W]$$

$$\theta_W=\theta_{W0}-\omega_W^2/2\alpha_W+\omega_W(t-mT_W-t_1)-\alpha_W[t-mT_W-t_1-(\theta_{W1}-\theta_{W0})/\omega_W]^2/2$$

If $t_1+(\theta_{W1}-\theta_{W0})/\omega_W+2\omega_W/\alpha_W\leqq t-mT_W\leqq t_1+2(\theta_{W1}-\theta_{W0})/\omega_W+\omega_W/\alpha_W$, then $$\theta_W'=-\omega_W$$

$$\theta_W=2\theta_{W1}-\theta_{W0}+3\omega_W^2/2\alpha_W-\omega_W(t-mT_W-t_1)$$

If $t_1+2(\theta_{W1}-\theta_{W0})/\omega_W+\omega_W/\alpha_W\leqq t-mT_W\leqq t_1+2(\theta_{W1}-\theta_{W0})/\omega_W+2\omega_W/\alpha_W$, then $$\theta_W'=-\omega_W+\alpha_W[t-mT_W-t_1-2(\theta_{W1}-\theta_{W0})/\omega_W-\omega_W/\alpha_W]$$

$$\theta_W=2\theta_{W1}-\theta_{W0}-3\omega_W^2/2\alpha_W-\omega_W(t-mT_W-t_1)+\alpha_W[t-mT_W-t_1-2(\theta_{W1}-\theta_{W0})/\omega_W-\omega_W/\alpha_W]^2/2$$

If $t_1+2(\theta_{W1}-\theta_{W0})/\omega_W+2\omega_W/\alpha_W\leqq t-mT_W\leqq t_1+2(\theta_{W1}-\theta_{W0})/\omega_W+2\omega_W/\alpha_W+\delta$, then $$\theta_W'=0$$

$$\theta_W=\theta_{W0}$$

As described above, the rotational angle $\theta_W$ of the top ring 20 at an arbitrary time t can be determined uniquely based on the time $t_1$ when the top ring 20 is at the minimum swing angle $\theta_{W0}$. Letting $(X_C, Y_C)$ be the center C of the swing motion, coordinates $(X_W, Y_W)$ of the substrate center can be given by $$X_W=X_C+R_W\cos\theta_W,\ Y_W=Y_C+R_W\sin\theta_W \tag{4}$$

A distance D between the monitoring sensor 52 and the substrate center at the time t is given by $$D=\sqrt{[(X_S-X_W)^2+(Y_S-Y_W)^2]} \tag{5}$$

If the distance D exceeds the radius of the substrate W, the monitoring sensor 52 is located outwardly of the substrate W and therefore cannot monitor the substrate condition.

A velocity pattern when the swing motion is performed is not limited to this example, and may be expressed by sine wave for instance. Although the position of the top ring 20 at the time $t_1$ provides the minimum angle $\theta_{W0}$ of the swing motion, once the position of the top ring 20 at a certain time is determined, the coordinates of the substrate center at an arbitrary time can be calculated as well.

From the above, the followings are derived.

[1] The swing motion of the top ring 20 is preferably started after a predetermined timer has elapsed from when the proximity sensor 101 senses the sensor target 103 at a first time when polishing the substrate W. Specifically, the swing motion of the top ring 20 is preferably started in synchronization with the rotation of the polishing table 18. If the swing motion of the top ring 20 is started in this timing, the positions of the substrate center when the monitoring sensor 52 scans the substrate W at a first revolution, a second revolution, . . . , n-th revolution are equal between plural substrates W That is, the radial positions of the loci of the monitoring sensor with respect to the substrate W are equal between substrates. Therefore, monitoring and controlling with no variation between substrates can be realized. That is, $$t_1=t_0+\tau \tag{6}$$

The predetermined time i may be determined in consideration of delays due to calculation and communication that are performed from when the proximity sensor 101 senses the sensor target 103 to when the swing motion is started.

[2] Further, it is possible to calculate the central position of the substrate W during polishing using the equation (4) and determine the distance D of the measuring point of the monitoring sensor 52 from the substrate center, i.e., the radial position of the measuring point, at each point of time during polishing using the equation (5). If the rotational speed of the polishing table 18 and the speed and acceleration of the swing motion of the top ring 20 are shifted from their preset values, error may be accumulated with the polishing time. In such a case, the rotation period of the polishing table 18 and the period of the swing motion of the top ring 20 are measured actually and calculation is performed based on these measurements so as to reduce the affects.

[3] In the paragraphs [1] and [2], the rotational speed of the polishing table 18 and the specification of the swing motion of the top ring 20 are set such that a value of n times the rotation period of the polishing table 18 and a value of m times the swing period of the top ring 20 (m and n are relatively prime integers) agree with a time T (for example, 3 seconds, 5 second, 10 seconds). As a result, the locus of the monitoring sensor takes the same radial position every time the polishing table 18 makes n revolutions, as described previously. Therefore, more stable monitoring and controlling can be realized over the entire polishing time.

Figure 10:
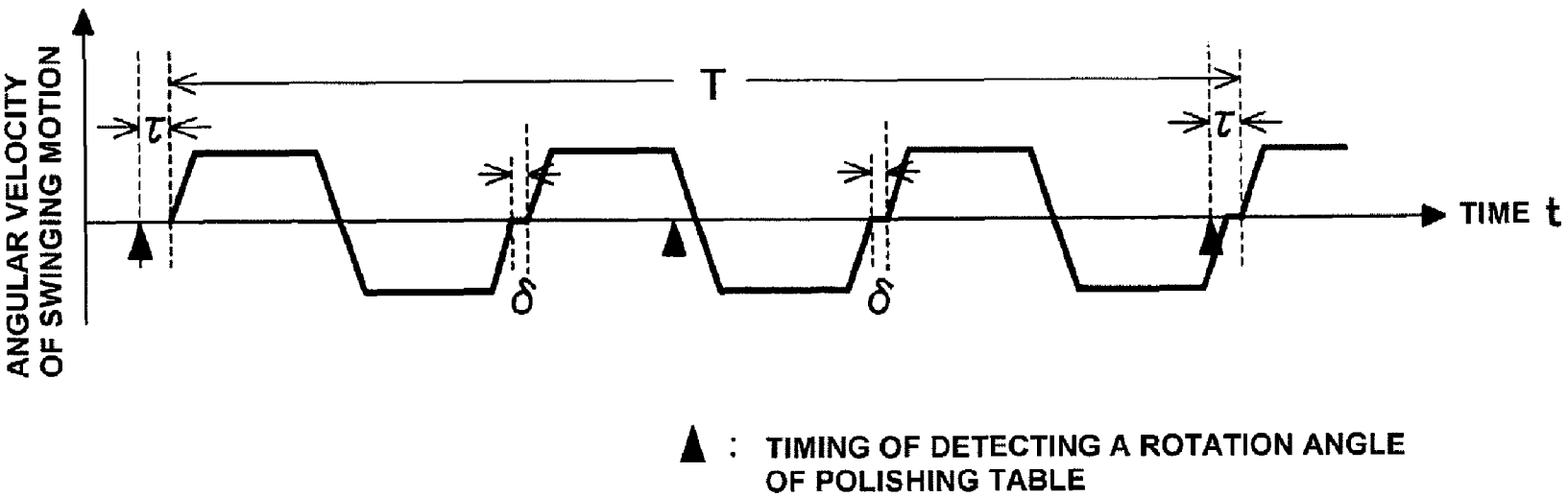
FIG. 10 is a view showing the manner of a change in angular velocity of a swing motion of the top ring.

[4] Further, in the paragraphs [1] and [2], the swing motion of the top ring 20 is stopped for the period of time δ (for example, δ is about 200 ms) each time the top ring 20 makes one swing motion (one reciprocation), as shown in FIG. 10. Further, every time the top ring 20 makes m swing motions, a time when the polishing table 18 is detected to be at a predetermined angle of rotation is replaced with a time $t_0$, if it is just before the end of m-th swing motion of the top ring 20, and the top ring 20 performs the next swing motion at the time $t_1$ that is given by the equation (6). That is, synchronization between the rotation of the polishing table 18 and the swing motion of the top ring 20 is established each time a first period of time ($=nT_S$) elapses, i.e., at intervals of the first period of time. This makes it possible to prevent accumulation of the error even if the rotational speed of the polishing table 18 or the specification of the swing motion of the top ring 20 is slightly deviated from its preset value or fluctuates slightly. Therefore, the monitoring sensor 52 and the substrate center repeat substantially the same positional relationship on a cycle of time T, and the locus of the monitoring sensor takes the same radial position every time the polishing table 18 makes n revolutions. Therefore, stable monitoring and controlling can be realized over the entire polishing time, regardless of mechanical difference or slight fluctuation of mechanical part. In order to reduce the influence of the error, it is preferable that the predetermined angle of rotation be set to be an angle corresponding to a time that is shortly before a point of time when the monitoring sensor 52 starts scanning the substrate W.

Figure 11:
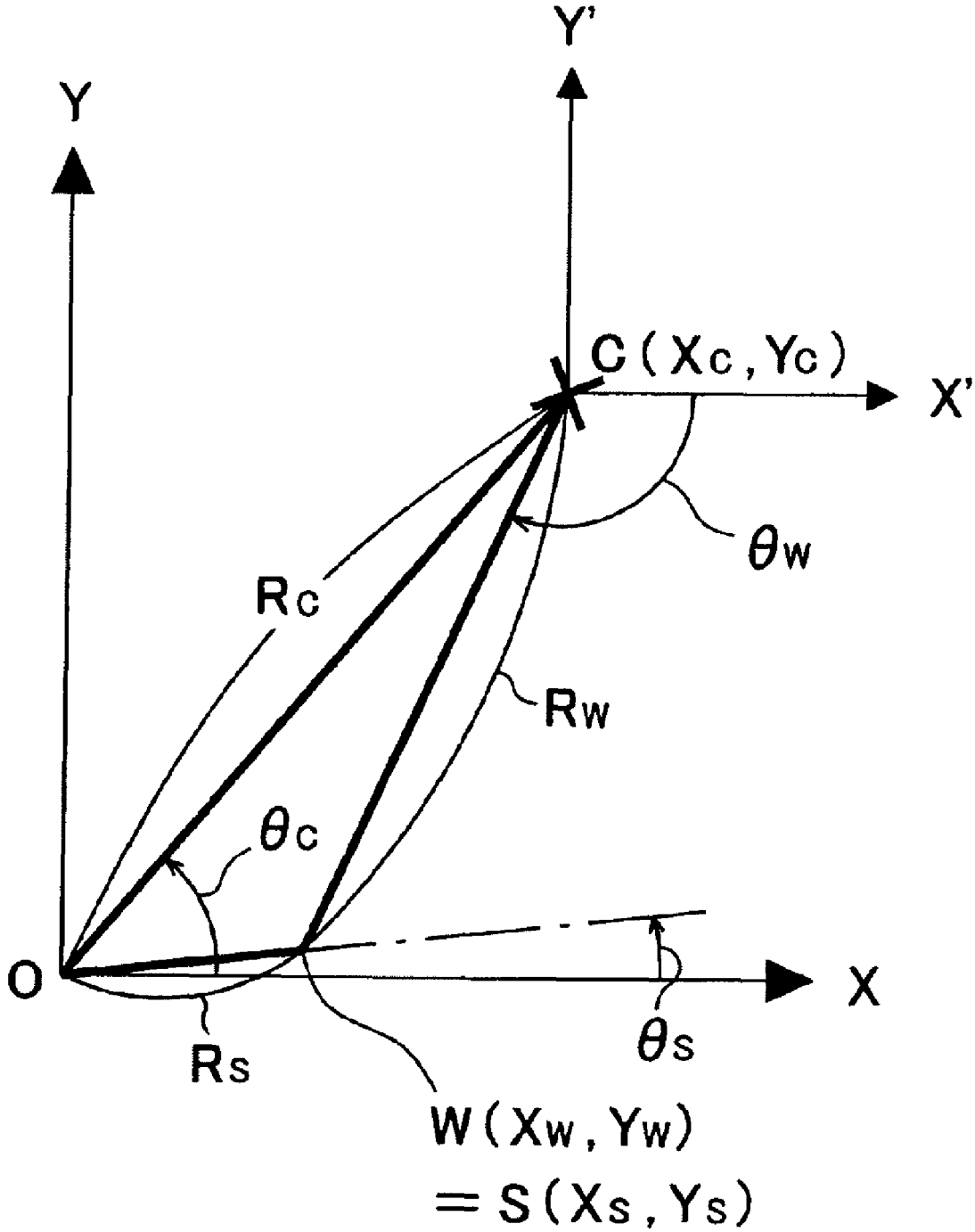
FIG. 11 is a view showing the positional relationship between the substrate center and a monitoring sensor.

[5] In addition, in the paragraphs [1], [2], and [4], the timer is determined such that the monitoring sensor 52 passes through the substrate center at least one time during the time T. Where $R_C$ represents a distance of the swing center C from the origin and $\theta_C$ represents an angle with respect to an X axis as shown in FIG. 11, $R_C$, $X_C$, and $Y_C$ are expressed as follows.

$$R_C=\sqrt{(X_C^2+Y_C^2)},\ X_C=R_C\cos\theta_C,\ Y_C=R_C\sin\theta_C$$

If D is zero (D=0) in the equation (5) and the equations (2) and (4) hold, the following equations are given by the theorem of cosines.

$$\cos(\theta_S-\theta_C)=(R_S^2+R_C^2-R_W^2)/2R_S\cdot R_C$$

$$\cos(\theta_C-\theta_W)=-(R_W^2+R_C^2-R_S^2)/2R_W\cdot R_C$$

Therefore, for example, the substrate center and the monitoring sensor 52 have the positional relationship as illustrated in FIG. 11.

That is, if $\theta_S<\theta_C$ and $\theta_W+\pi>\theta_C$, then $$\theta_S=\theta_C-a\cos[(R_S^2+R_C^2-R_W^2)/2R_S\cdot R_C]2m_S\pi$$

$$\theta_W=\theta_C+a\cos[(R_W^2+R_C^2-R_S^2)/2R_W\cdot R_C]+(2m_W-1)\pi$$

where $m_S$ and $m_W$ are integers.

Therefore, supposing that the monitoring sensor 52 passes through the substrate center under the conditions that the equation (1) and, for example, the equation (3) hold, the following equations are obtained from the equation (3).

$$t=t_0+[\theta_C-a\cos[(R_S^2+R_C^2-R_W^2)/2R_S\cdot R_C]+2m_S\pi-\theta_{S0}]/\omega_S$$

$$t=t_1+[\theta_C+a\cos[(R_W^2+R_C^2-R_S^2)/2R_W\cdot R_C]+(2m_W-1)\pi-\theta_{W0}]/\omega_W+\omega_W/2\alpha_W+mT_W$$

Therefore, supposing that the monitoring sensor 52 passes through the substrate center at an initial stage of polishing and m, $m_S$, $m_W$ are 0, then the following equation is obtained from the equation (6).

$$\tau=[\theta_C-\theta_{S0}-a\cos[(R_S^2+R_C^2-R_W^2)/2R_S\cdot R_C]]/\omega_S+[\theta_{W0}-\theta_C-a\cos[(R_W^2+R_C^2-R_S^2)/2R_W\cdot R_C]+\pi]/\omega_W-\omega_W/2\alpha_W$$

In other cases also, the time τ can be determined as well.

Accordingly, when the top ring 20 swings such that the monitoring sensor 52 passes approximately through the center of the top ring 20 at least one time during the first period of time, the monitoring sensor 52 can securely monitor the substrate center (where singular phenomenon, such as excessive or insufficient polishing, is likely to occur) at least one time while the polishing table 18 makes n revolutions.

Further, in order to detect the polished conditions of all of the zones C1, C2, C3, and C4 each time the polishing table 18 makes one revolution, it is necessary to establish an amplitude of the swing motion of the top ring 20 such that the monitoring sensor 52 passes through the central zone C1, which is the innermost zone of the top ring 20.

Figure 12:
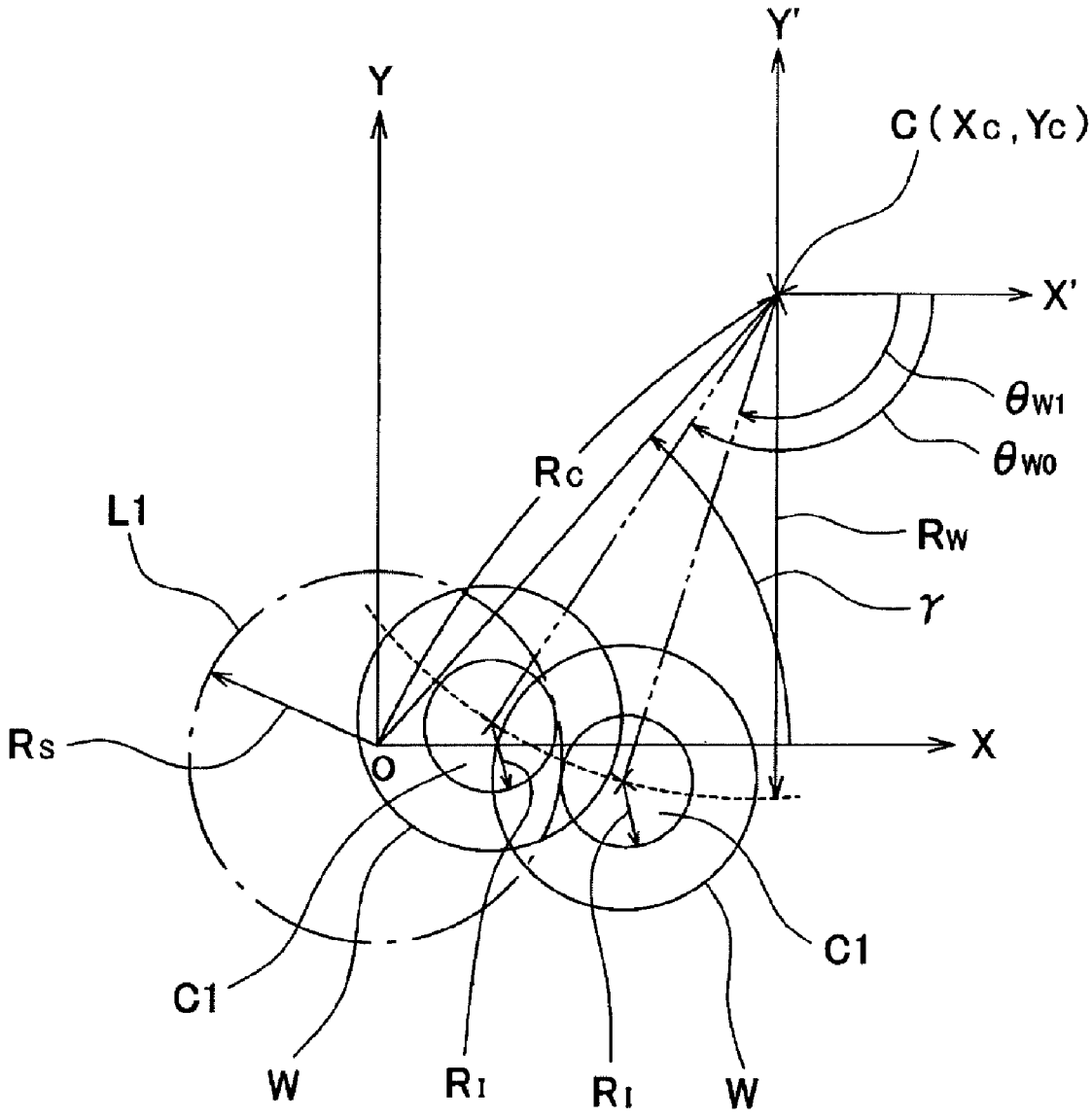
FIG. 12 is a view illustrating a method of determining an amplitude of the swing motion of the top ring.

FIG. 12 is a view illustrating a method of determining the amplitude of the swing motion of the top ring 20. Under the condition that the locus L1 of the monitoring sensor and a periphery of the central zone C1 of the substrate W have the positional relationship such that they are brought into contact with each other as illustrated in FIG. 12 when the top ring 20 is at both ends of the swing motion, the monitoring sensor 52 passes through the central zone C1 every time the polishing table 18 makes a revolution regardless of the rotational speed of the polishing table 18, the period of the swing motion of the top ring 20, and the timing (i.e., a difference in phase between the rotation of the polishing table 18 and the swing motion of the top ring 20).

Therefore, in FIG. 12, letting $R_1$ be a radius of the central zone C1, $$(R_S-R_1)^2\leqq(X_C+R_W\cos\theta_W)^2+(Y_C+R_W\sin\theta_W)^2\leqq(R_S+R_1)^2$$

In the case as illustrated in FIG. 12, if $-\pi<\theta_W<0$, then $$a\cos[(R_C^2+R_W^2-(R_S-R_1)^2)/2R_C\cdot R_W]+\gamma-\pi\leqq\theta_W\leqq a\cos[(R_C^2+R_W^2-(R_S+R_1)^2)/2R_C\cdot R_W]+\gamma-\pi$$

$$\cos\gamma=X_C/R_C,\ \sin\gamma=Y_C/R_C$$

Under these conditions, the monitoring sensor 52 scans a portion of the surface W corresponding to the central zone C1 every time the polishing table 18 makes one revolution. This makes it easy and effective to control the profile of the substrate.

Figure 13:
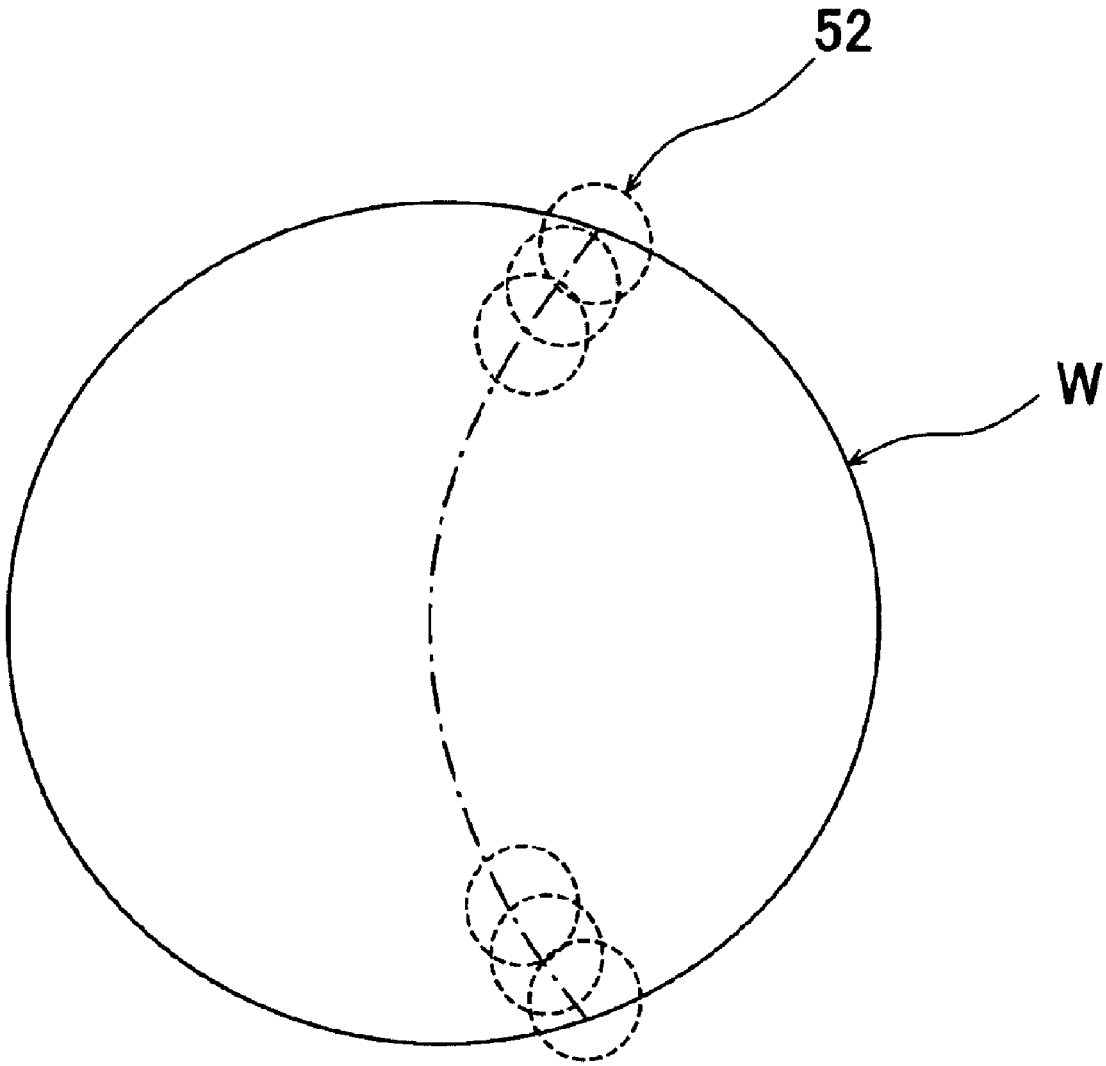
FIG. 13 is a view showing a locus described on the substrate by the monitoring sensor, which is an eddy current sensor, moving across the substrate.

FIG. 13 is a view illustrating a locus of movement of a measuring spot (i.e., an effective measuring zone) on the surface of the substrate W when the monitoring sensor 52, which is an eddy current sensor in this example, scans the surface of the substrate W one time. In the case of using the eddy current sensor as the monitoring sensor 52, the measuring spot thereof has a finite area because of its fundamental mechanism. Therefore, when the center of the measuring spot comes close to the edge of the substrate W, part of the measuring spot is away from a film-formed area on the substrate W As a result, the output of the sensor is lowered.

Figure 14:
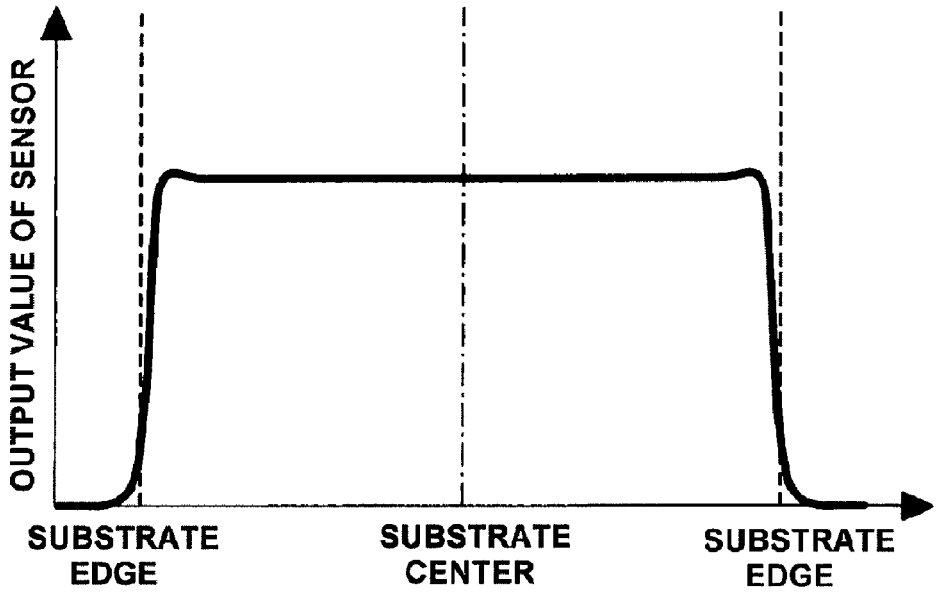
FIG. 14 is a diagram showing output value of the eddy current sensor when scanning the substrate.

FIG. 14 shows the output value of the eddy current sensor when scanning a substrate (blanket wafer) having a copper film, with substantially a uniform thickness, formed on a surface thereof. As described above, the output value of the eddy current sensor is lowered sharply near the edge of the substrate.

Figure 15:
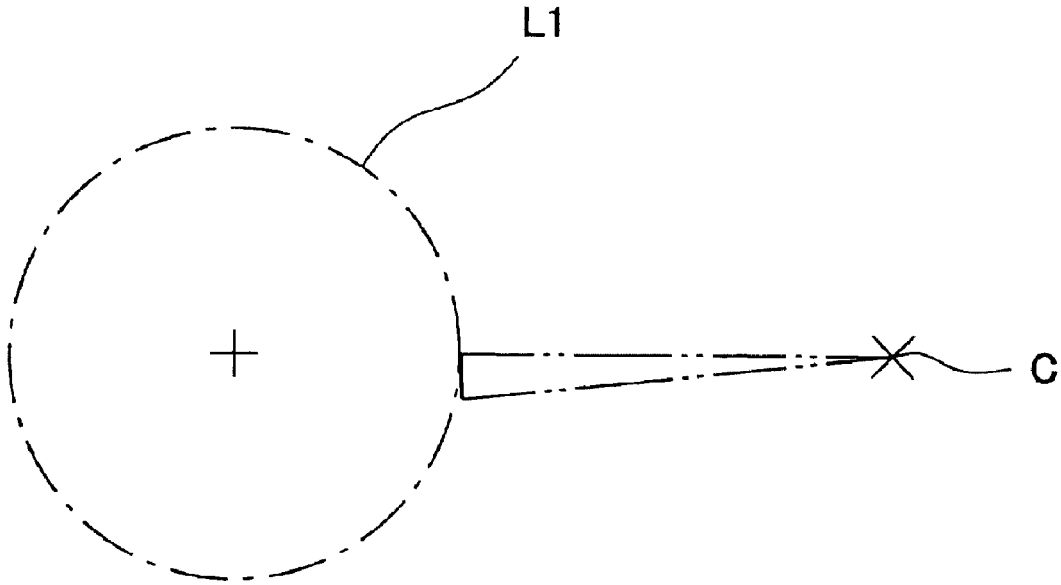
FIG. 15 is a view illustrating a case where a locus of the swing motion of the top ring center contacts the locus L1 of the monitoring sensor.
Figure 16A:
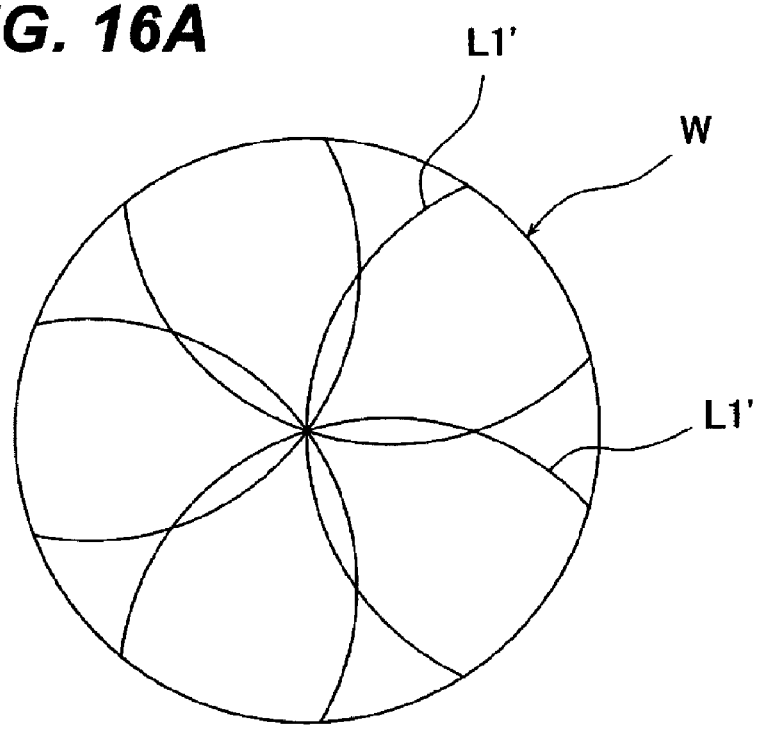
FIG. 16A is a view showing an example of the sensor-in-substrate loci L1' in the case of FIG. 15.

FIG. 15 illustrates a case where a locus of the center of the top ring 20 performing the swing motion contacts the locus L1 of the monitoring sensor. The locus of the monitoring sensor on the surface of the substrate, i.e., the sensor-in-substrate locus L1', in this case is illustrated in FIG. 16A (however, in FIG. 16A, the top ring 20 is not swung). In this example, a ratio of the rotational speed of the polishing table 18 to the rotational speed of the top ring 20 is adjusted to 5:6, so that the locus of the monitoring sensor 52 makes one revolution in the circumferential direction on the surface of the substrate each time the polishing table makes five revolutions. In this manner, the rotational speeds of the top ring 20 and the polishing table 18 are established such that the sensor-in-substrate loci L1' are distributed substantially uniformly over the entire circumference of the surface, to be polished, of the substrate W. This makes it possible for the monitoring sensor 52 to uniformly scan the surface of the substrate substantially in its entirety within a predetermined measuring time, without biased scanning on a local area on the surface of the substrate W. As a result, the monitoring sensor can grasp average film thickness with less influence of a variation in the film thickness in the circumferential direction of the surface of the substrate.

Figure 16B:
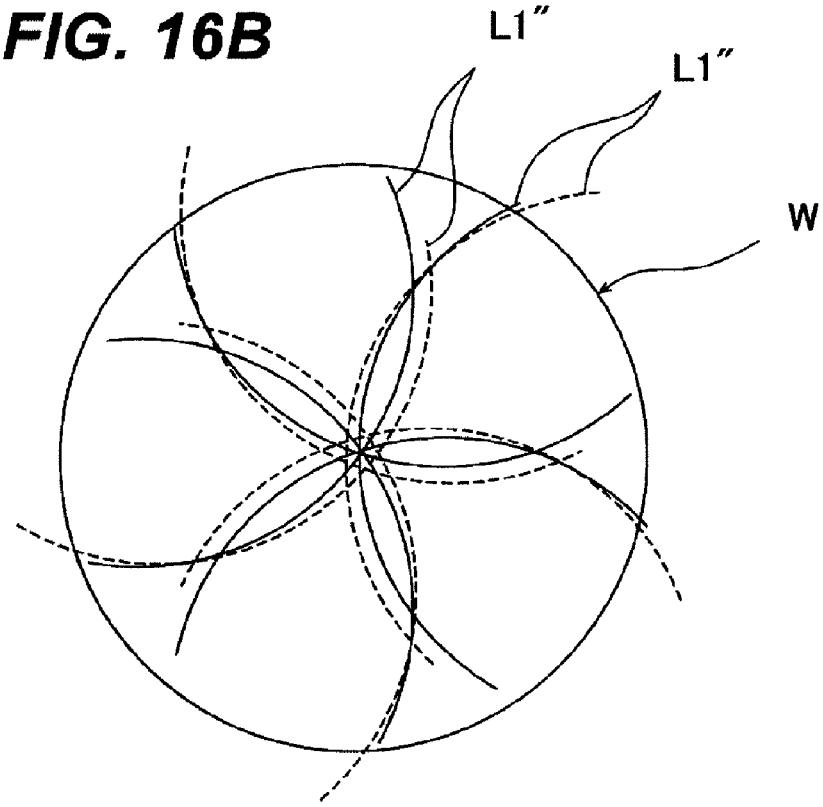
FIG. 16B is a view showing an example of tentative sensor-in-substrate loci L1" in the case of FIG. 15.

Specifically, in the examples shown in FIG. 16A and FIG. 16B, the rotational speed of the polishing table 18 is set to 60 rpm and the rotational speed of the top ring 20 is set to 72 rpm. Solid lines in FIG. 16A represent the sensor-in-substrate loci L1' on the surface of the substrate in a case where the top ring 20 does not swing as mentioned above. Solid lines and dotted lines in FIG. 16B represent tentative sensor-in-substrate loci L1" that are obtained on the assumption that the top ring 20 does not perform the swing motion while the top ring 20 actually performs the swing motion as illustrated in FIG. 15. FIG. 16B shows how the tentative sensor-in-substrate loci L1" are actually distributed on the surface of the substrate.

In the case of FIG. 16A, the monitoring sensor 52 describes the same locus each time the polishing table 18 makes five revolutions, and the monitoring sensor 52 passes through the center of the substrate W each time the monitoring sensor 52 scans the surface of the substrate W. On the other hand, in the case of FIG. 16B, the monitoring sensor 52 passes through the same radial position on the surface of the substrate W each time the polishing table 18 makes two revolutions, the monitoring sensor 52 describes the same locus each time the polishing table 18 makes ten revolutions, and the monitoring sensor 52 passes approximately through the center of the substrate W (although not accurate) each time the monitoring sensor 52 scans the surface of the substrate W. Therefore, monitoring data of the substrate W obtained on the assumption that the substrate W does not swing can be used for monitoring the condition of the substrate W during polishing thereof.

As indicated by the dotted lines and the solid lines in FIG. 16B, when the tentative sensor-in-substrate locus L1" begins early near the edge of the substrate, the tentative sensor-in-substrate locus L1" ends early near the edge of the substrate, and when the tentative sensor-in-substrate locus L1" begins late near the edge of the substrate, the tentative sensor-in-substrate locus L1" ends late near the edge of the substrate. Therefore, assuming that a center of the tentative sensor-in-substrate locus L1" is regarded as the substrate center and comparing the monitoring data of the measuring points on both sides at equal distance from the center of the tentative sensor-in-substrate locus L1", the monitoring data of the measuring point on one side is larger than that on the other side in most cases. Thus, an average of the monitoring data of the measuring points on both sides at equal distance is used as a monitoring data for that radial position.

Figure 17:
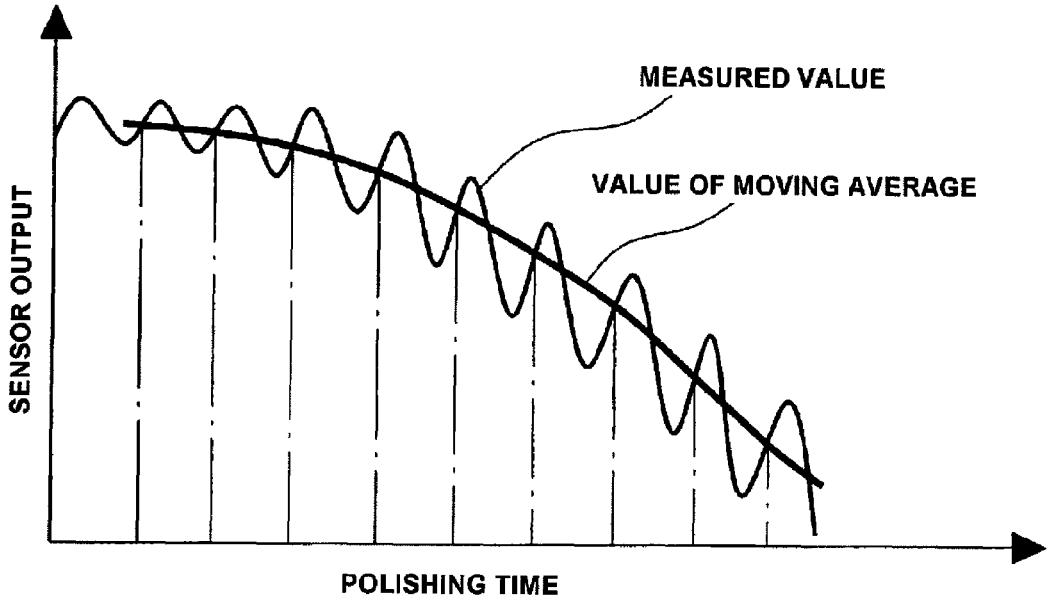
FIG. 17 is a view showing a relationship between the output of the monitoring sensor and a polishing time.
Figure 18:
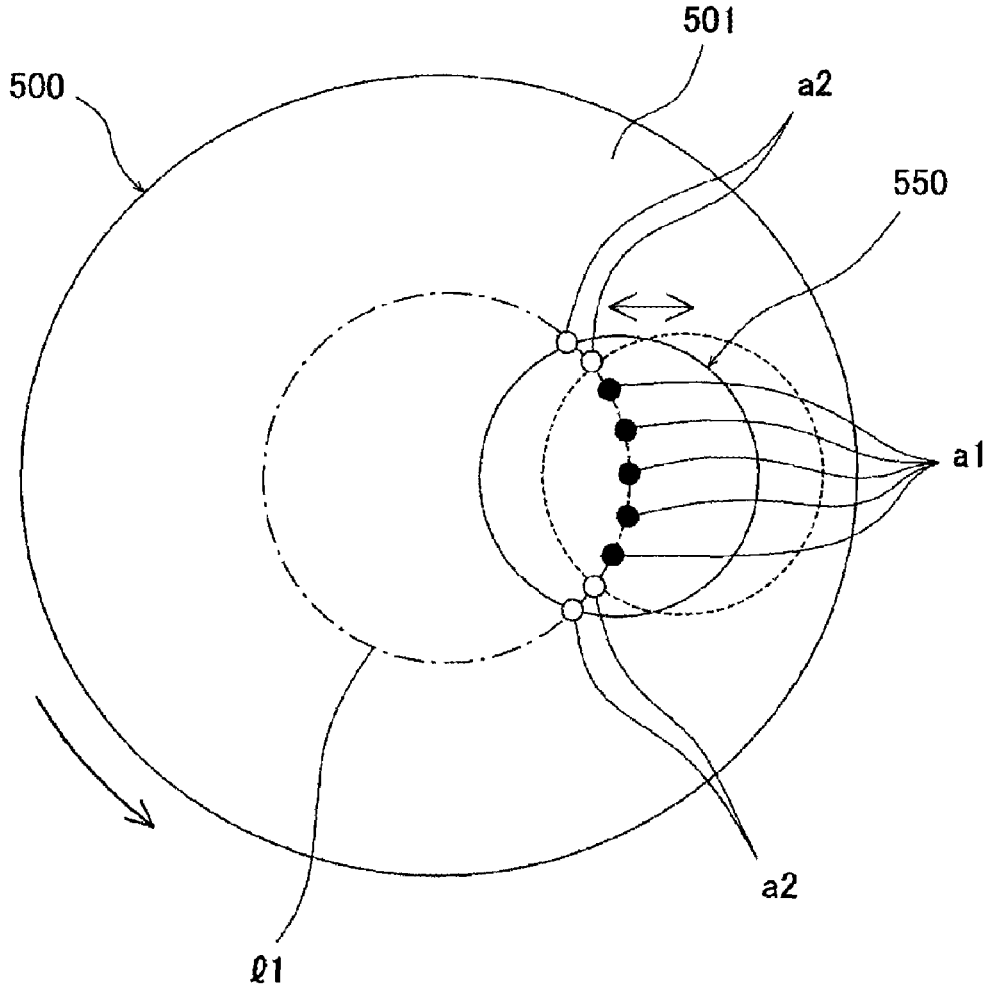
FIG. 18 PRIOR ART
FIG. 18 is a view showing a positional relationship between a polishing table and a substrate in a CMP apparatus.

Further, a moving average of the monitoring data during n revolutions of the polishing table 18 (corresponding to m times the swing period of the top ring 20) may be calculated. Use of the moving average thus obtained can reduce error of the monitoring data obtained at every rotation of the polishing table 18 as shown in FIG. 17, and a film-thickness profile can be grasped relatively.

That is, in the case where the locus of the center of the swinging top ring 20 contacts the locus of the monitoring sensor during monitoring of the substrate, the monitoring data on each zone of the top ring 20 may be determined on the assumption that the top ring 20 does not swing and the moving average may be calculated with regard to the monitoring data that are obtained while the polishing table 18 makes revolution(s) corresponding to the first integer n, for the purpose of monitoring the substrate condition during polishing.

In the above-discussed embodiments, the top ring swings around a predetermined axis, i.e., along a circular arc orbit. However, the manner of the swing motion of the top ring is not limited to that in the embodiments. For example, the top ring may swing so as to describe substantially an oval orbit on the polishing table.

What is claimed is:

1. A method of polishing a substrate, comprising:

rotating a polishing table having a polishing surface, a monitoring sensor being mounted on the polishing table;

holding a substrate by a top ring;

bringing the substrate into contact with the polishing surface while swinging and rotating the top ring to polish the substrate; and monitoring a surface condition of the substrate by the monitoring sensor during polishing of the substrate, wherein a rotational speed of the polishing table and conditions of swing motion of the top ring are determined such that a position of the monitoring sensor, a position of a center of rotation of the top ring, and a direction of the swing motion of the top ring at a point of time when a predetermined period of time has elapsed after polishing of the substrate is started approximately coincide with their previous values at a point of time before said predetermined period of time has elapsed.

2. The method according to claim 1, wherein a polishing time for the substrate is at least three times said predetermined period of time.

3. The method according to claim 1, further comprising:

performing a predetermined arithmetic process on a signal from the monitoring sensor to create a monitoring signal; and controlling a pressing force of the top ring applied to the substrate, based on the monitoring signal.

4. The method according to claim 1, wherein an integral multiple of said predetermined period of time is equal to a period of a moving average for smoothing monitoring data.

5. The method according to claim 1, wherein the swing motion of the top ring is started in synchronization with rotation of the polishing table.

6. The method according to claim 5, further comprising:

calculating a central position of the top ring during polishing of the substrate; and determining a distance of a measuring point of the monitoring sensor from a substrate center.

7. The method according to claim 1, further comprising:

establishing synchronization between the rotation of the polishing table and the swing motion of the top ring each time said predetermined period of time elapses.

8. The method according to claim 7, wherein the top ring is swung such that the monitoring sensor passes approximately through the center of the top ring at least one time during said predetermined period of time.

9. The method according to claim 1, wherein the top ring has concentric plural zones capable of pressing the substrate with independently adjusted forces, and an amplitude of the swing motion of the top ring is determined such that the monitoring sensor passes through an innermost zone each time the polishing table makes one revolution.

10. The method according to claim 1, wherein said monitoring is performed using a moving average of monitoring data with respect to each zone of the top ring, and the monitoring data are obtained under a condition that a locus of the center of the top ring performing the swing motion contacts a locus of the monitoring sensor when monitoring the substrate and on an assumption that the top ring does not perform the swing motion.

11. An apparatus for polishing a substrate, comprising:

a polishing table having a polishing surface, said polishing table being rotatable;

a top ring configured to hold a substrate and bring the substrate into contact with said polishing table while swinging and rotating the substrate;

a monitoring sensor configured to detect a surface condition of the substrate during polishing of the substrate, said monitoring sensor being mounted on said polishing table; and a controller configured to control swing motion and rotation of said top ring and control rotation of said polishing table, wherein said controller is further configured to control the rotation of said polishing table and the swing motion of said top ring such that a position of said monitoring sensor, a position of a center of the rotation of said top ring, and a direction of the swing motion of said top ring at a point of time when a predetermined period of time has elapsed after polishing of the substrate is started approximately coincide with their previous values at a point of time before said predetermined period of time has elapsed.

12. A method of monitoring a substrate, comprising:

rotating a polishing table having a polishing surface, a monitoring sensor being mounted on the polishing table so as to face the polishing surface of the polishing table;

holding the substrate by a top ring;

bringing the substrate into contact with the polishing surface while swinging and rotating the top ring to polish the substrate through relative motion between the top ring and the polishing table;

monitoring a surface condition of the substrate by the monitoring sensor during polishing of the substrate while controlling a radial distance of a locus of the monitoring sensor described on a surface, to be polished, of the substrate from a center of the substrate; and determining a ratio of a swing period of the top ring to a rotation period of the polishing table to establish a distribution of loci of the monitoring sensor.

* * * * *